US007270092B2

(12) United States Patent
Hefley

(10) Patent No.: US 7,270,092 B2
(45) Date of Patent: Sep. 18, 2007

(54) VARIABLE DISPLACEMENT/COMPRESSION ENGINE

(76) Inventor: Carl D. Hefley, 46125 E. Highway 60-70, Suite 31, Salome, AZ (US) 85348

( * ) Notice: Subject to any disclaimer, the term of this patent is extended or adjusted under 35 U.S.C. 154(b) by 0 days.

(21) Appl. No.: 11/463,409

(22) Filed: Aug. 9, 2006

(65) Prior Publication Data

US 2007/0034186 A1 Feb. 15, 2007

Related U.S. Application Data

(60) Provisional application No. 60/707,858, filed on Aug. 12, 2005.

(51) Int. Cl.
*F02B 75/04* (2006.01)
*F02B 75/22* (2006.01)

(52) U.S. Cl. ..... 123/48 B; 123/54.1; 123/78 BA; 123/78 F

(58) Field of Classification Search ..... 123/48 B, 123/78 BA, 78 E, 78 F, 54.1–54.8, 55.1, 123/1 A, 27 GE, 525, 526, 44 R, 43 C
See application file for complete search history.

(56) References Cited

U.S. PATENT DOCUMENTS 1,891,321 A * 12/1932 Woolson ..... 123/48 B
4,024,841 A 5/1977 Smith
4,033,304 A 7/1977 Luria
4,066,049 A 1/1978 Teodorescu et al.
4,077,269 A 3/1978 Hodgkinson
4,086,879 A 5/1978 Turnbull
4,138,973 A 2/1979 Luria
4,270,495 A 6/1981 Freudenstein et al.
4,455,128 A 6/1984 Seybold
4,469,055 A * 9/1984 Caswell ..... 123/48 B
4,495,930 A * 1/1985 Nakajima ..... 123/1 A
4,530,316 A 7/1985 Morrison
4,612,882 A 9/1986 Bonfilio
4,625,683 A 12/1986 Bonfilio
4,741,300 A 5/1988 Benson
4,788,952 A 12/1988 Schonholzer
4,803,914 A 2/1989 Vekony et al.
4,836,149 A 6/1989 Newbold
4,884,530 A * 12/1989 Boekhaus et al. ..... 123/1 A
4,934,347 A 6/1990 Suga et al.
5,025,756 A 6/1991 Nyc
5,123,394 A 6/1992 Ogren
5,136,987 A 8/1992 Schechter et al.
5,335,427 A 8/1994 Partio (Continued)

*Primary Examiner*—Noah P. Kamen
(74) *Attorney, Agent, or Firm*—Robert D. Atkins; Quarles & Brady LLP

(57) ABSTRACT

An internal combustion engine with improved efficiency provides continuous variable displacement and/or compression ratio tuning to one of a number of fuel types to be used by the engine. By varying displacement without changing the compression ratio, the engine can be tuned to operate on a given fuel more efficiently according to the load demands on the engine. By varying the compression ratio, the engine can be converted for use with the most economical fuel type available. The engine can be of a radial configuration with an offset crankshaft and a common cam throw-piece that can be positioned on the crankshaft to change the stroke and/or compression ratio affected by one or an array of pistons. An onboard electronic control can be used to detect engine efficiency, change engine displacement and/or compression ratio, change fuel supply, and compute fuel economy.

14 Claims, 14 Drawing Sheets

U.S. PATENT DOCUMENTS 5,335,632 A 8/1994 Hefley
5,375,564 A 12/1994 Gail
5,406,911 A 4/1995 Hefley
5,433,179 A 7/1995 Wittry
5,531,197 A 7/1996 Lobb
5,546,908 A * 8/1996 Stokes ..... 123/525
6,062,175 A 5/2000 Huang
6,125,801 A * 10/2000 Mendler ..... 123/48 R
6,220,208 B1 4/2001 van de Werve
6,273,208 B1 8/2001 Sand
6,279,550 B1 8/2001 Bryant
6,354,250 B1 3/2002 Rodriguez Lopez
6,390,035 B2 5/2002 Moteki et al.
6,427,643 B1 * 8/2002 Dixon ..... 123/48 A
6,453,869 B1 9/2002 Moore
6,457,443 B1 10/2002 Lillbacka
6,499,449 B2 12/2002 Michelini et al.
6,505,582 B2 1/2003 Moteki et al.
6,526,925 B1 3/2003 Green, Jr.
6,546,900 B2 4/2003 Arai et al.
6,591,807 B1 7/2003 Ardes
6,604,495 B2 8/2003 Moteki
6,615,773 B2 9/2003 Moteki et al.
6,619,267 B1 9/2003 Pao
6,640,543 B1 11/2003 Seal
6,684,828 B2 2/2004 Ushijima et al.
6,814,032 B2 * 11/2004 Goto ..... 23/27 GE
2005/0087155 A1 * 4/2005 Kikori ..... 123/78 C

* cited by examiner

FIG. 8
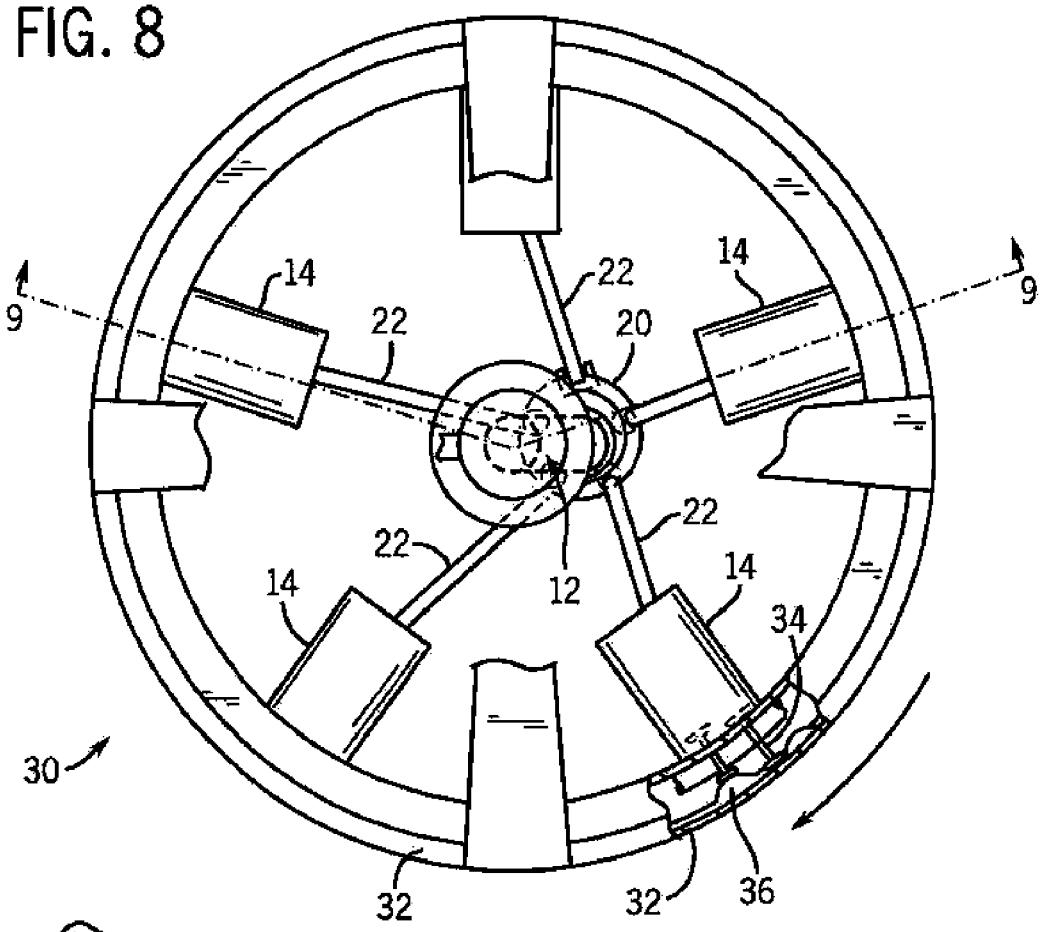
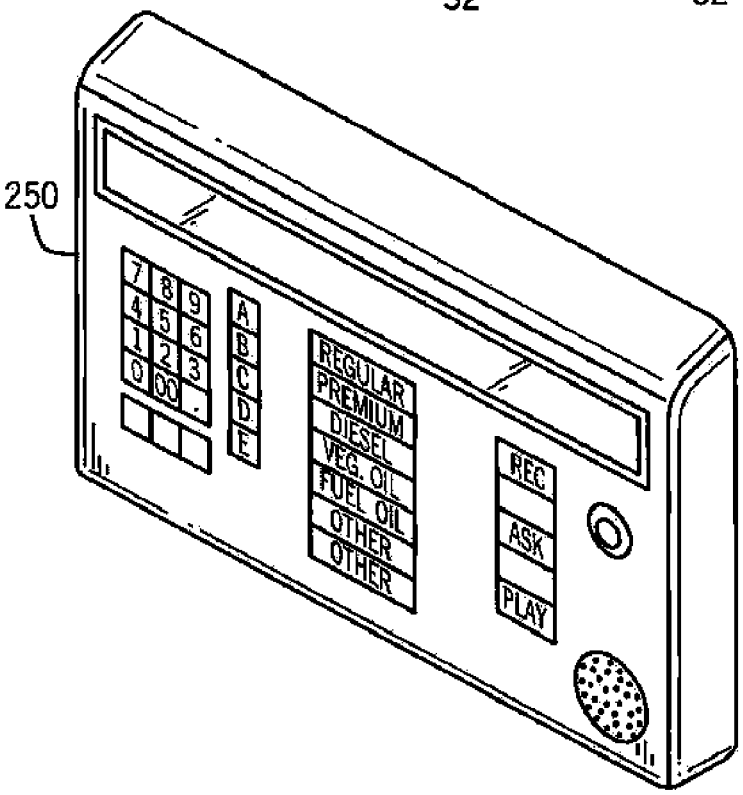
FIG. 22

FIG. 17
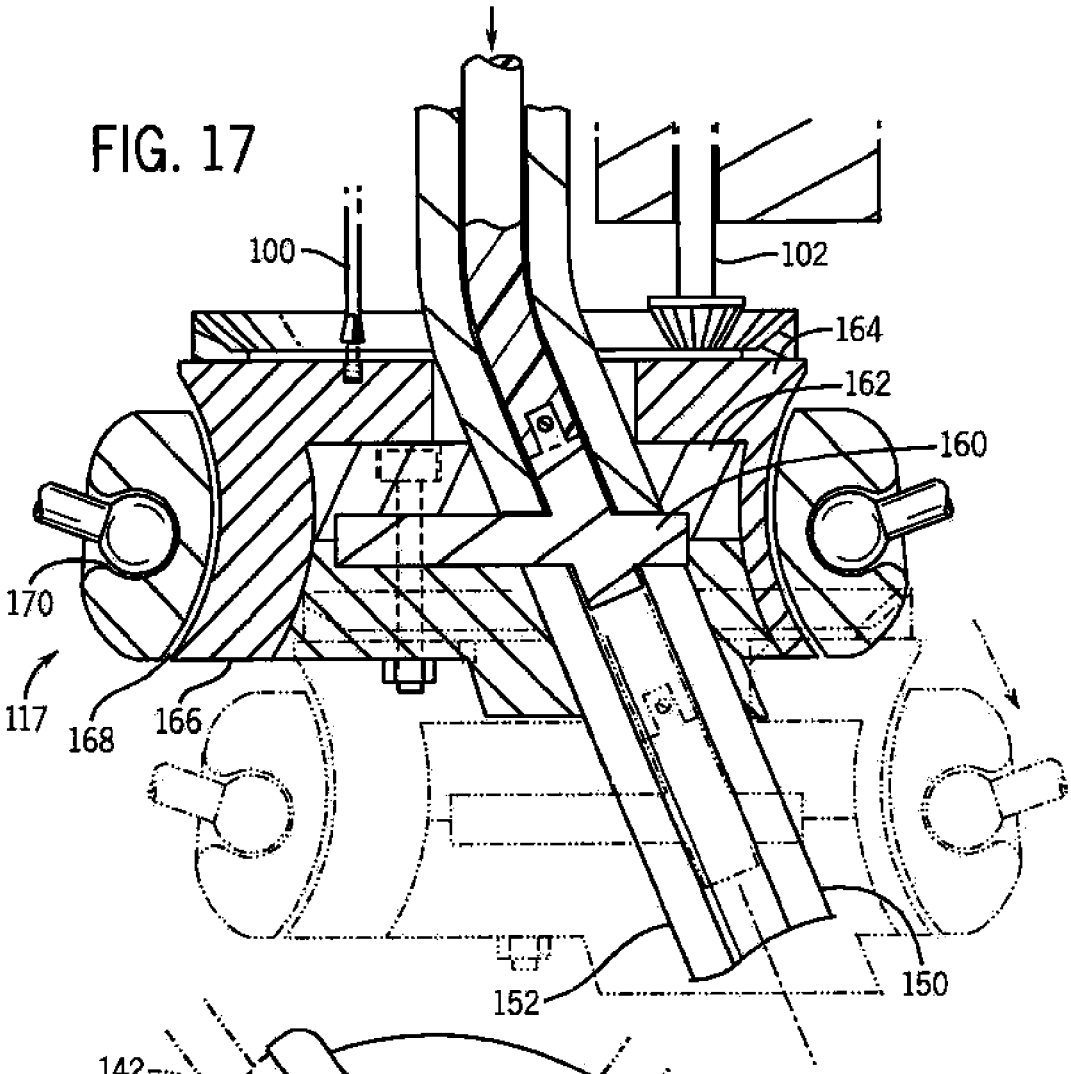
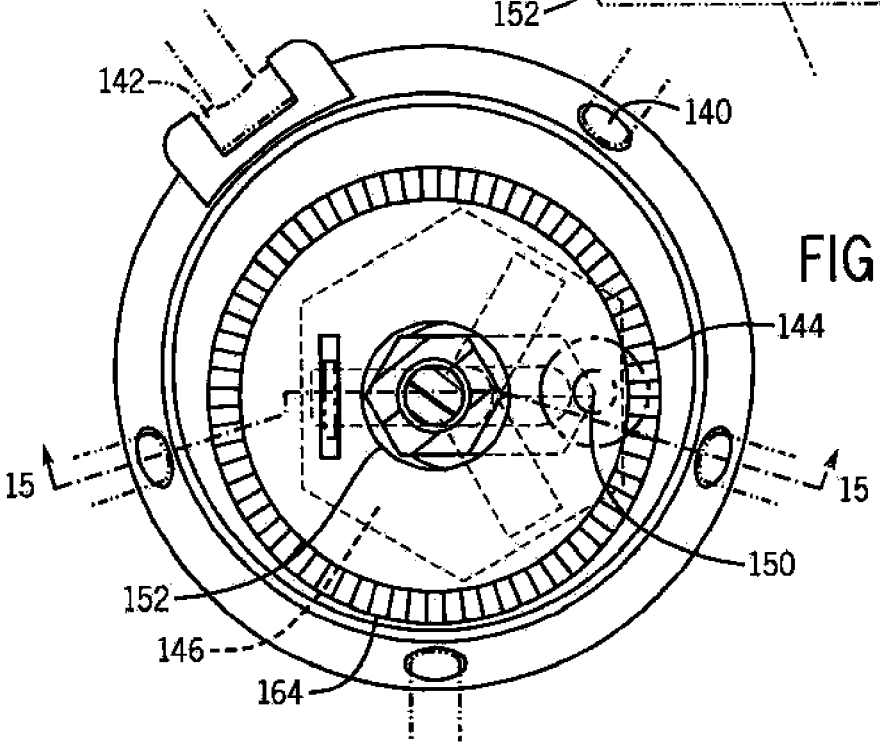
FIG. 16

VARIABLE DISPLACEMENT/COMPRESSION ENGINE

CLAIM TO DOMESTIC PRIORITY

The present non-provisional patent application claims priority to provisional application Ser. No. 60/707,858 entitled "Variable Displacement/Compression Engine," filed on Aug. 12, 2005.

FIELD OF THE INVENTION

The present invention relates in general to internal combustion engines and, more particularly, to an internal combustion engine having adjustable compression and displacement for increasing power and efficiency and reducing fuel consumption.

BACKGROUND OF THE INVENTION

Internal combustion engines are well known to provide power for public and private transportation and other motorized applications. While some engine designs, such as the Wankel rotary engine, do not make use of pistons and cylinders, it is conventional in automobiles to use internal combustion engines with one or more piston-cylinder arrangements. The conventional reciprocating combustion engine uses a piston to compress a working fluid, such as gasoline, with air in a cylinder chamber. The mixture is then ignited by a spark and the resultant explosion drives the piston a fixed distance along the length of the cylinder. The energy generated by the ignition, and the subsequent linear movement of the piston, is transmitted through a piston rod, which is connected to a rotating crankshaft that provides output power, for example, to turn the wheels of an automobile.

The conventional internal combustion engine has been in existence for over a hundred years; in fact, as early as 1885, Daimler and Benz of Germany developed engines of this same type which are still being used in today's automobiles. Even though many improvements have been made throughout the years, the basic design of the internal combustion engine has remained relatively the same: A rigid block holds the cylinders, while the pistons go up and down a fixed distance via a heavy rigid crankshaft. Since the block is solid, the pistons travel up to a top point, as determined by the designer. The diameter of the pistons and the length of the stroke determine the displacement of air/vapor from the cylinder.

The designer decides in advance whether the engine is to run on regular or high-octane fuel. If regular fuel is chosen, the engine may be set to have a compression ratio of about 10:1 (stroke of 9-10 millimeters compresses air/vapor to 1 millimeter). For high-octane fuel and engines with ping sensors, the compression ratio is 12-14:1 (stroke of 12-14 millimeters compresses air/vapor to 1 millimeter). In general, a higher compression causes a more powerful explosion on the piston, thus giving the engine more power for the amount of fuel consumed.

The compression ratios are based on the engine running wide open—allowing maximum air/fuel vapor into the engine. However, when the engine is running at half power, the air/fuel vapor is reduced by half. The compression ratio drops by half because the engine is not fully charged. The engine that had a 9-10:1 compression ratio suddenly has only about a 4.5-5.0:1 compression ratio, and it is no longer operating at full efficiency. The power produced by a 4.5-5.0:1 compression is generally not considered efficient.

Common automobile engine designs arrange the pistons and cylinders in a V-shape, in-line (straight), or in flat (boxer) patterns. A "V-6" engine, for example, is arranged with a bank of three cylinders at opposite sides of the engine, with each bank being at an oblique angle to the other. A multi-cylinder flat in-line engine has two opposed banks of cylinders, and a multi-cylinder in-line engine has all of the cylinders aligned in a single bank. Each configuration has somewhat different performance characteristics, form factors, and manufacturing complexities that may make it more suitable for certain vehicles.

Another type of piston-cylinder internal combustion engine, which is less common in the automotive industry, is the radial engine. As the name suggests, the radial engine design arranges the cylinders in a radial or angularly spaced circular pattern around the crankshaft. Typically, a "master" piston rod is fixed, or mounted by a non-pivoting link pin to the throw-piece, while the other "articulating" piston rods mount to the throw-piece by pivoting connections that allow them to rotate as the crankshaft and pistons move. The cylinder pattern gives the radial engine at least one distinct advantage over the other engine designs, and that is instead of using a long crankshaft with each piston moved by a different cam lobe, there is a single hub-like throw-piece to which all of the pistons connect.

Because of the radial engine's characteristic high power output, relatively low maximum engine speed allowing in some cases direct drive of the propeller without reduction gearing, and suitability for air-cooling instead of the weightier water-cooling process, radial engines have been historically used as airplane power plants. Today, radial engines in the airplane industry have largely been replaced by more common engine configurations or gas turbine engines, which are generally much lighter in weight.

Internal combustion engines of any design operate most efficiently when tuned to the load conditions applied to the engine. The cylinder count and size and the piston stroke are selected to provide an internal pressure and volumetric displacement corresponding to a particular output power. However, engine loading typically varies during operation, such as when changing speeds in an automobile, or when navigating steep terrain, or when towing a load. During times of engine operation when the output power is lower or higher than the load demands, the engine is operating inefficiently. Conventional engines are designed so that peak power and efficiency are available when the engine operates at full load. When conventional engines are operated at less than full load, less power is needed and, therefore, the power output is reduced by throttling back the air-fuel mixture, which reduces the pressure in the cylinders and increases the residual gas content following combustion, resulting in decreased operating efficiency. Such inefficiencies result in high fuel consumption and increased operating costs to the user.

Most engines are designed for maximum efficiency in the wide-open state. However, such a wide-open state is seldom the case during normal engine operation. At the wide-open setting, the engine receives the proper oxygen flow to ignite at the best pressure for the type of fuel being used. For example, suppose that a regular gasoline burns best when ignited at 150 pounds of pressure. The engine may use a compression ratio of 10:1. Inefficiencies will occur when the throttle is partly closed because less air goes into the cylinder, causing the optimum pressure of 150 pounds to suddenly drop, perhaps to only 75 pounds. Ignition still takes place, but not at its optimum level. Gas is still burned, but not efficiently, and economy is lost.

Trying to optimize the output power and efficiency of the engine over a wide range of operating conditions has been difficult to achieve in practice. Attempts to optimize performance characteristics for one operating condition often reduce the engine efficiency for other operating conditions. Hence, a need exists for an improved mechanical arrangement in an internal combustion engine that can compensate for varying operating conditions while maintaining peak efficiency at high or low output power.

SUMMARY OF THE INVENTION

In one embodiment, the present invention is an engine comprising a crankshaft having a main section extending along a main axis and an offset section radially offset from the main axis. A throw-piece is mounted to the crankshaft and movable along the offset section. At least one piston and cylinder arrangement is provided. The piston has one end coupled to the throw-piece and extends generally radially from the crankshaft to a head disposed within the cylinder. The piston has a movable a stroke distance with respect to the cylinder so as to displace a volume of air/vapor in the cylinder when moved through the stroke distance. The movement of the throw-piece along the offset section of the crankshaft causes a changed piston-stroke distance and a changed cylinder-volume displacement by movement of the piston through the changed stroke distance.

In another embodiment, the present invention is a multi-fuel engine comprising a crankshaft having a main section extending along a main axis. A cam engine has a cam surface that is eccentric with respect to the crankshaft. At least one of an angular position and an axial position of the cam is adjustable relative to the crankshaft. At least one piston and cylinder arrangement is provided. The piston has one end coupled to the cam and extends generally radially from the crankshaft to a head disposed within the cylinder. The piston is movable through a stroke with respect to the cylinder. The angular position of the cam with respect to the crankshaft can be selected to tune a compression ratio of the engine to a preferred compression ratio of a fuel being supplied to the engine.

In another embodiment, the present invention is a method of improving the fuel economy of an engine having a crankshaft and one or more piston and cylinder arrangements in which each piston is coupled to the crank shaft at a common throw-piece. The method includes the steps of selecting a fuel type having a preferred compression ratio for combustion, and setting the position of the throw-piece with respect to the crankcase to effect a compression ratio by movement of the piston in the cylinder that corresponds to the preferred compression ratio, wherein the engine is capable of consuming any of a plurality of combustible fuels.

In another embodiment, the present invention is a method of improving the fuel economy of an engine having one or more piston and cylinder arrangements. The method includes the steps of determining a current engine efficiency based on use of a current fuel type, calculating an alternative engine efficiency based on use of an alternative fuel type, comparing the alternative engine efficiency to the current engine efficiency, tuning a compression ratio of the piston and cylinder arrangement(s) to correspond to a preferred compression ratio of the alternative fuel type, and supplying the engine with the alternative fuel type.

BRIEF DESCRIPTION OF THE DRAWINGS

FIG. 8 is a top plan view of one embodiment of a 5-cylinder engine;

FIG. 16 illustrates a top view of the crankshaft mechanism;

FIG. 17 illustrates the cage in the top-most position and ready to be repositioned;

FIG. 22 represents an onboard electronic control module used to detect engine performance.

DETAILED DESCRIPTION OF THE DRAWINGS

Figure 1:
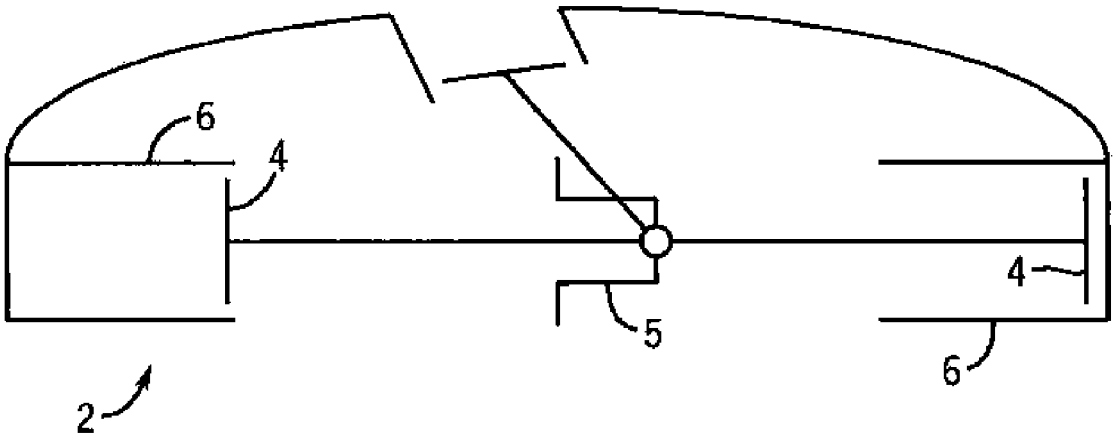
FIG. 1 (PRIOR ART)
FIG. 1 illustrates a piston and cylinder arrangement in a well-known internal combustion engine.

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

An internal combustion engine is described with its efficiency improved by in-use variable displacement and/or compression ratio tuning of the engine. The engine can be constructed and designed to burn fuel at optimum pressure over a wide range of loading and operating conditions, e.g., whether a large output power is required or a smaller output power is desired. In the present engine design, the displacement or internal volume of the engine can be changed while in operation. The stroke becomes shorter, reducing the displacement, and the piston moves closer to the top of the cylinder, keeping the ideal compression ratio for that engine and the type fuel being utilized. The same combustion pressure is maintained at smaller displacement sizes. As a result, each combustion of the engine is executed at high efficiency. More output power is produced with larger displacement configurations; less output power is produced with smaller displacements. However, the output power that is produced is created with high efficiency of whatever fuel is being combusted, resulting in higher overall efficiency and economy. By shortening the piston stroke, the displacement is reduced by more than 50 percent of its maximum displacement, yet the engine still runs efficiently. By varying displacement, the engine can be tuned to operate on a given fuel more efficiently according to the load demands on the engine. By varying the compression ratio, the engine can be converted for use with the most desirable fuel type available, for example, the fuel that produces the most power for the price.

The compression ratio for a gasoline engine may range from 9:1 to 14:1 depending on the octane level of the fuel. The compression on a diesel engine is even higher—in the range of 22:1 or higher. The difference between a gasoline engine and a diesel engine is only minimal; in fact a gasoline engine can become a diesel engine simply by changing the fuel injector system, using more heat-resistant valves, and increasing the compression ratio. A diesel-powered car is more energy-efficient than a gasoline-powered car; however, the high compression ratio of 22:1 is hard for conventional engines to handle. The user may hear a 'ping' if the fuel/air mixture is not ideal, and smoke and odors often are noticeable, especially at idle or low speeds.

The present engine does not have a conventional crankshaft and solid block, nor does it have a fixed displacement or fixed compression ratio. The present engine design can maintain the same compression ratio while it changes its internal displacement. When an auto is operating on any particular fuel, the engine will adjust itself to an ideal compression ratio to get the most thrust from that fuel. A smaller engine will idle using far less fuel than a larger engine. Because the present engine becomes smaller internally when less power is needed, it will be much more fuel-efficient. However, unlike a conventional small engine, the present engine can quickly increase its displacement and return to full power.

More specifically, the present engine design has a crankshaft with a main section extending along a main axis, and an offset section radially offset from the main axis. A throw-piece mounts to the crankshaft to be movable along the offset section. The throw-piece couples at least one piston and cylinder arrangement. The piston is movable a stroke distance with respect to the cylinder so as to displace a volume of air in the cylinder. Movement of the throw-piece along the offset section of the crankshaft changes the piston-stroke distance and, correspondingly, the cylinder volume displaced by the piston. The crankshaft only has one throw, and all pistons are attached to just one throw on the crank. When adjustments are made to the crank, it will affect all pistons equally.

The principles of the design can be carried out in a variety of engine configurations. In one embodiment, the engine has a radial design in which the crankshaft is disposed centrally and one piston/cylinder assembly, or multiple angularly spaced piston/cylinder assemblies, is disposed radially from the crankshaft. In this engine type, several pistons can be mounted to a single throw-piece so that the throw and/or relative position of each piston with respect to the associated cylinder can be set by adjusting the throw-piece. The engine configuration also allows for either a rotating crankshaft or a stationary crankshaft, and revolving piston/cylinder arrangement. In the latter case, the pistons and cylinders can revolve about the crankshaft in independent, oblique orbits to effect relative reciprocation of the pistons in the cylinders. In either case, the offset section of the crankshaft can extend from the main section along an offset axis that is oblique to the main axis. Each of the cylinders is oriented so that its centerline is oblique to the main axis and can be perpendicular to the offset axis.

The throw-piece is positioned along the offset section of the crankshaft to maintain an essentially constant compression ratio in the cylinder when not being adjusted. The throw-piece can have a cam that has an eccentric surface, the angular orientation of which can be adjusted to change the position of the pistons relative to the cylinders, thereby changing the compression ratio of the engine. An actuator is used to rotate the cam with respect to the crankshaft once unlocked. A flexible drive-member movable within a passage of the crankshaft is coupled to the throw-piece to move the throw-piece along the offset section of the crankshaft.

Radial engines are known for their power and reliability and have often been used in fighter aircraft and commercial airplanes before the age of jet engines. The radial engine has pistons and cylinders placed in a circle around a crankshaft at about a 90-degree angle (+/−5%) from the crankshaft. All of the piston rods are placed on only one journal of the crankshaft. Additional banks of cylinders will increase power. The radial engine is selected for the present embodiment because of its ability to change the stroke on one rod, whereby all of the pistons are affected at the same time.

Another aspect of the present design provides a multi-fuel engine having a crankshaft and a cam with an eccentric surface that is adjustable in one or more of its angular and axial positions relative to the crankshaft. The angular position of the cam with respect to the crankcase can be selected to tune the compression ratio of the engine to the preferred compression ratio of any fuel being supplied to the engine. The cam is presented as a strong and rugged adjusting device mounted on the crankshaft. A number of other mechanical devices, including a sliding track or adjustable table mechanism, can replace the cam.

Another aspect of the present design is a method of improving the fuel economy of an engine capable of consuming any of a plurality of combustible fuels. The method includes the steps of selecting a fuel type having a preferred compression ratio for combustion, and setting the position of the throw-piece with respect to the crankshaft to effect a compression ratio by movement of the cam located on said throw-piece that corresponds to the preferred compression ratio.

Yet another aspect of the design is a method of improving the fuel economy of an engine, including the steps of determining a current engine efficiency based on the use of a current fuel type, calculating an alternative engine efficiency based on the use of an alternative fuel type, comparing the alternative engine efficiency to the current engine efficiency, tuning a compression ratio of the piston and cylinder arrangements to correspond to a preferred compression ratio of the alternative fuel type, and supplying the engine with the alternative fuel type.

Still another aspect of the engine design involves the electronic monitoring and control of the engine. An in-vehicle, perhaps dashboard-mounted, user-controlled interface can be coupled to a vehicle's master computer or other dedicated computer system to read, record, and evaluate engine sensors and to control actuators for adjusting the axial position of the throw-piece and/or the rotational position of the cam along the crankshaft in order to control adjustment of the engine compression ratio and/or displacement. The computer control can have electronic components for calculating a current engine efficiency based on the use of a particular fuel type and calculating an alternative engine efficiency based on the use of an alternative fuel type. The system can thus be used to tune the engine to the load requirements as well as determine, select, and optimize the engine for any fuel type consumed by the engine.

Turning to FIG. 1, a conventional radial internal combustion engine 2 is shown with piston 4 connected to crankshaft 5. The piston moves in and out of cylinder 6 as it turns about crankshaft 5. The left-hand side of the figure shows piston 4 with maximum displacement; the right-hand side of the figure shows piston 4 with maximum compression at a later time in the engine cycle. FIG. 1 illustrates that internal combustion engine 2 maintains a fixed displacement regardless of load and operating conditions and accordingly exhibits the problems as described in the background.

Various aspects of the present invention are illustrated in FIGS. 2-7 as a simplified model of a radial design, internal combustion engine having an adjustable engine displacement. The figures illustrate a cross-section of the radial engine with two cylinders 14 and pistons 16 and 18 arranged in various positions around crankshaft 12. Pistons 16 and 18 are shown inside cylinders 14, representing the top of each piston which travels a certain distance inside the bore of cylinders 14.

Cylinders 14 are arranged in a pattern which resembles a conventional radial engine. A positioning arrangement, e.g., cylinders 14 radiating from a central crankshaft, allows for the use of a single crank journal, although additional journals could be utilized. The engine has cylinders placed in a circle with a crankshaft at certain angles near 90 degrees, but not at 90 degrees to the cylinders, and not quite directly in line with them. The number of cylinders is usually odd—3, 5, 7, and 9 on each bank, but could be any number. The figures show only one bank of cylinders, but one, two, or more banks can be utilized. Only one crankshaft 12 is needed, and only one crank journal is shown, however, more could be used. When an adjustment is made on the journal, it affects all the pistons at the same time. The engine design is applicable to embodiments where the crankshaft revolves, the cylinders are anchored, where the crankshaft is anchored to the frame, and the cylinders and pistons within are made to revolve.

Figure 2:
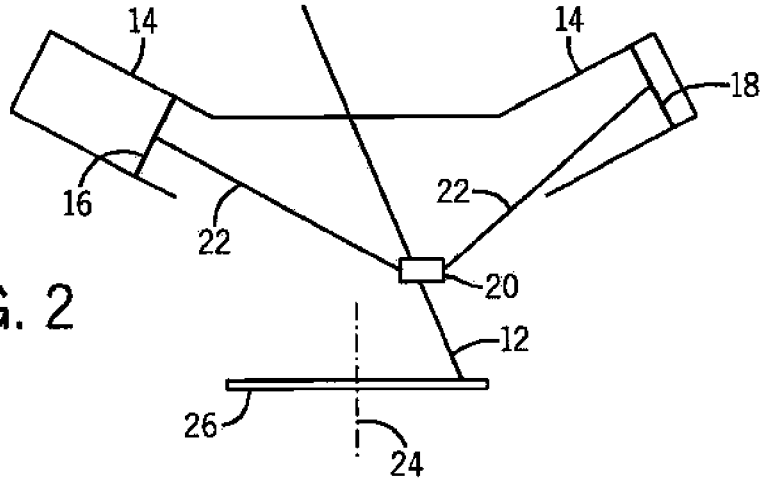
FIGS. 2-7 are simplified representations of a piston and cylinder arrangement in an internal combustion engine.

In FIG. 2, the center element 12 represents the crankshaft and corresponding angle. The angle of the crankshaft makes the present radial engine unique from other radial engines. Cylinders 14 are also positioned at an angle. The setting shows the rod bearings at the bottom, which means that as the crankshaft turns, it will have a long stroke, making the displacement large. This can be verified by looking at the left side, where piston 16 is taking a long stroke. At the right side, piston 18 is near the top. In the present embodiment, the pistons maintain a compression ratio of about 6:1, which is lower than that actually used in present engines. Gasoline engine ratios are typically found to be from 10:1 up to 13:1, and diesel and bio-diesel around 20:1 to 22:1. At the 6:1 settings, six increments of the right side will compress into one increment of the left side. The same will follow with other compression ratios.

Dotted line 24 represents a 90-degree angle that a crankshaft 12 would normally make with cylinders 14 and pistons 16-18 in a conventional radial internal combustion engine. Crankshaft 12 is shown at a certain angular position apart from 90-degree line 24, which may be less than or greater than the conventional 90-degree angle. Several positions along an axial length of crankshaft 12 are possible.

Figure 3:
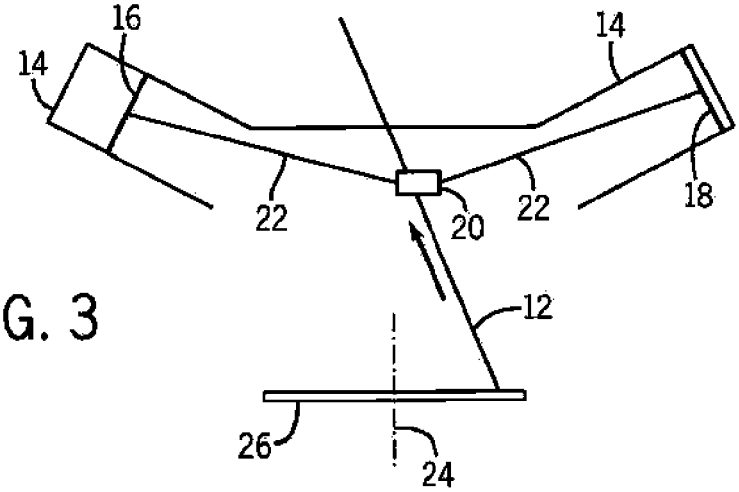

In FIG. 3, rod bearings 20 are raised closer to the top of rod 22, as crankshaft 12 turns with flywheel 26. Rod bearings 20 will have a full stroke that is equal to about one-half of the stroke shown in FIG. 2. Since the stroke has been shortened by about half, the displacement has decreased by half as well. If a normal crankshaft is reduced by half, then the distance to the top of the cylinder would also be reduced by half, and in the case of a conventional internal combustion engine, there would not be enough pressure to achieve good combustion. However, because of the angles and positioning in this engine, the distance between the top of piston 18 to the top of cylinder 14 does not decrease. Varying the position of rods 22 on crankshaft 12 along 90-degree line 24 reduces the distance from the top of piston 18 to the top of cylinder 14. So, the distance decreases at an appropriate amount to maintain the same compression ratio as the engine orientation in FIG. 2. The pistons automatically maintain relatively the same compression ratio. That is, about six increments (the increments are smaller) of the right side will fill the left side. So the displacement remains the same as the stroke is shortened. Note that this action is done automatically without having to move the head on the cylinder.

Figure 4:
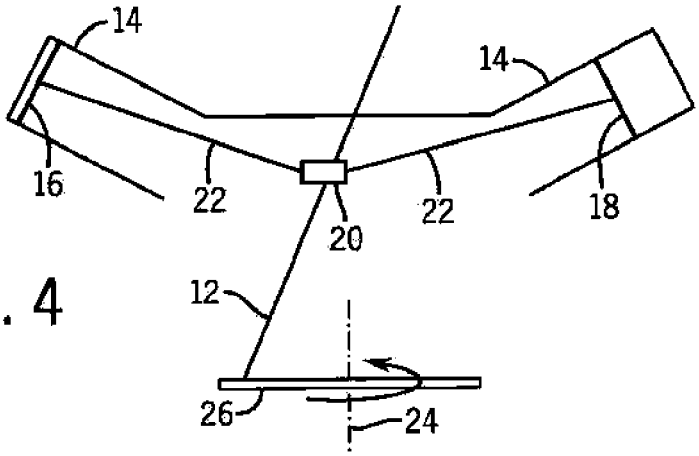

In FIG. 4, the arrow at the bottom shows that crankshaft 12 has revolved by 50 percent. The cylinder activity is reversed from FIG. 3.

Figure 5:
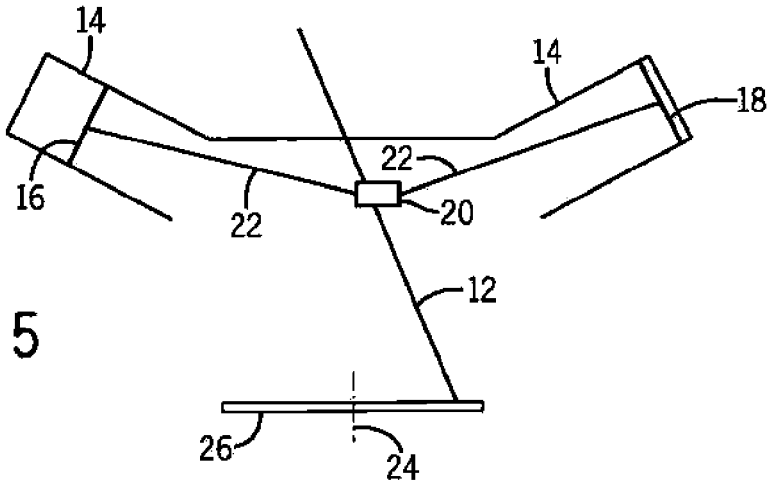

In FIG. 5, the engine orientation is similar to FIG. 3. The rods are connected to the right side, indicating the position of the camshaft inside the bearing. The camshaft will change the compression ratio when moved.

Figure 6:
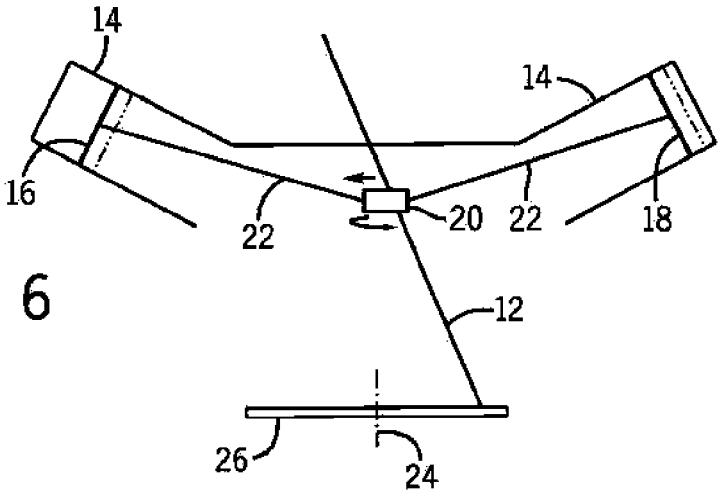

In FIG. 6, the camshaft on the crankshaft 12 has moved and will lock into this position until another movement is done to change the compression ratio and allow a driver to change from diesel back to regular fuel. According to the present engine model, three increments of the right side will fill the chamber on the left side, which means that the compression ratio has been lowered by 50 percent. Note that engines using gasoline normally have compression ratios about 50 percent lower than diesel engines. The stroke on the left side has also been shortened, which will not make much difference since it is the position of the piston at its most extended point that is relevant.

Figure 7:
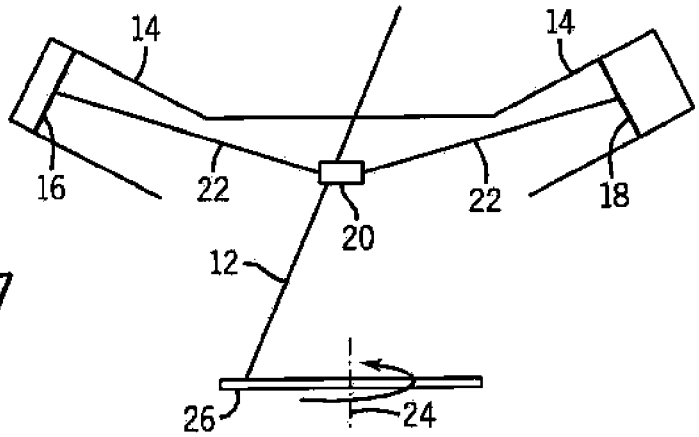

FIG. 7 illustrates the relative positions as the crankshaft rotates. The engine model is set to minimum displacement, and the pistons' stroke is short. The camshaft on crankshaft 12 remains in the same position.

So far, the discussion has addressed changing the displacement of the engine, i.e., the active amount of space the pistons are using. The distance is cut in half while maintaining the same compression ratio. A 500 cc engine would become a 250 cc engine. These changes can even be greater as the angles are altered to bring about the desired results.

Each fuel has its own best compression ratio assuming there are no restrictions in the airflow, such as closing the throttle would create. These restrictions actually change the effective compression ratio. An engine designed to operate at a 10:1 compression ratio actually runs at the effective 10:1 ratio when the throttle is wide open. When the throttle is set to ¼ or ½, the benefits of a 10:1 compression ratio diminish because air is not allowed in to charge up the cylinder as needed. The effective ratio could be as low as 4:1 or even less. The fuel is being ignited, but does not make a good effective explosion due partly to a lack of oxygen at this reduced power setting.

If a different fuel is used in the engine, that fuel will be utilized at its own best compression ratio. Regular gasoline may have its best explosion when it reaches a pressure of approximately 170 pounds. If the pressure is over 190 pounds, the gas could explode before it was ignited, which causes a 'ping' and a power loss. If the gas is ignited at 50 pounds, it would still burn, but it would produce a weak and inefficient thrust. The present engine is designed to keep the pressure as close as possible to that needed to produce an efficient combustion.

Assume the engine is running on regular gasoline and makes a very efficient combustion at 170 pounds, but detonates prematurely if the pressure reaches 190 pounds. The fuel is then changed to premium gasoline, which has its best combustion pressure at approximately 190 pounds and does not detonate prematurely until it reaches a pressure of 200 pounds. Under these circumstances, by opening the throttle, more oxygen is placed into the mixture and produces a hotter combustion and more power. In order to properly utilize the enhanced qualities of premium gasoline and raise the pressure, the compression ratio in the engine must be changed.

FIGS. 2-7 provided a simplified representation of the variable displacement operation of the present invention. FIG. 8 illustrates a circular radial engine 30 and the relative position of the cylinders and the pistons. Notice how the crankshaft, rotating offset from center (see FIG. 9), alters the displacement of the pistons within the cylinders. The piston rod bearings are not set at 90-degree angles from the crankshaft 12. Valve wheel 32 is shown around the perimeter of radial engine 30 and provides the unique feature of allowing all valves 34 to be activated by just the one mechanical piece. Valve wheel 32 eliminates the bearings, drives, and individual camshafts that are needed to operate the valve assemblies in conventional engines.

Inside valve wheel 32 is a track 36 for each row of valves 34. The track is embossed at the point that each valve should be activated. The valve wheel moves slower than the crankshaft. Only one wheel is needed to control all the valves on the engine, independent of the number of cylinders.

Figure 9:
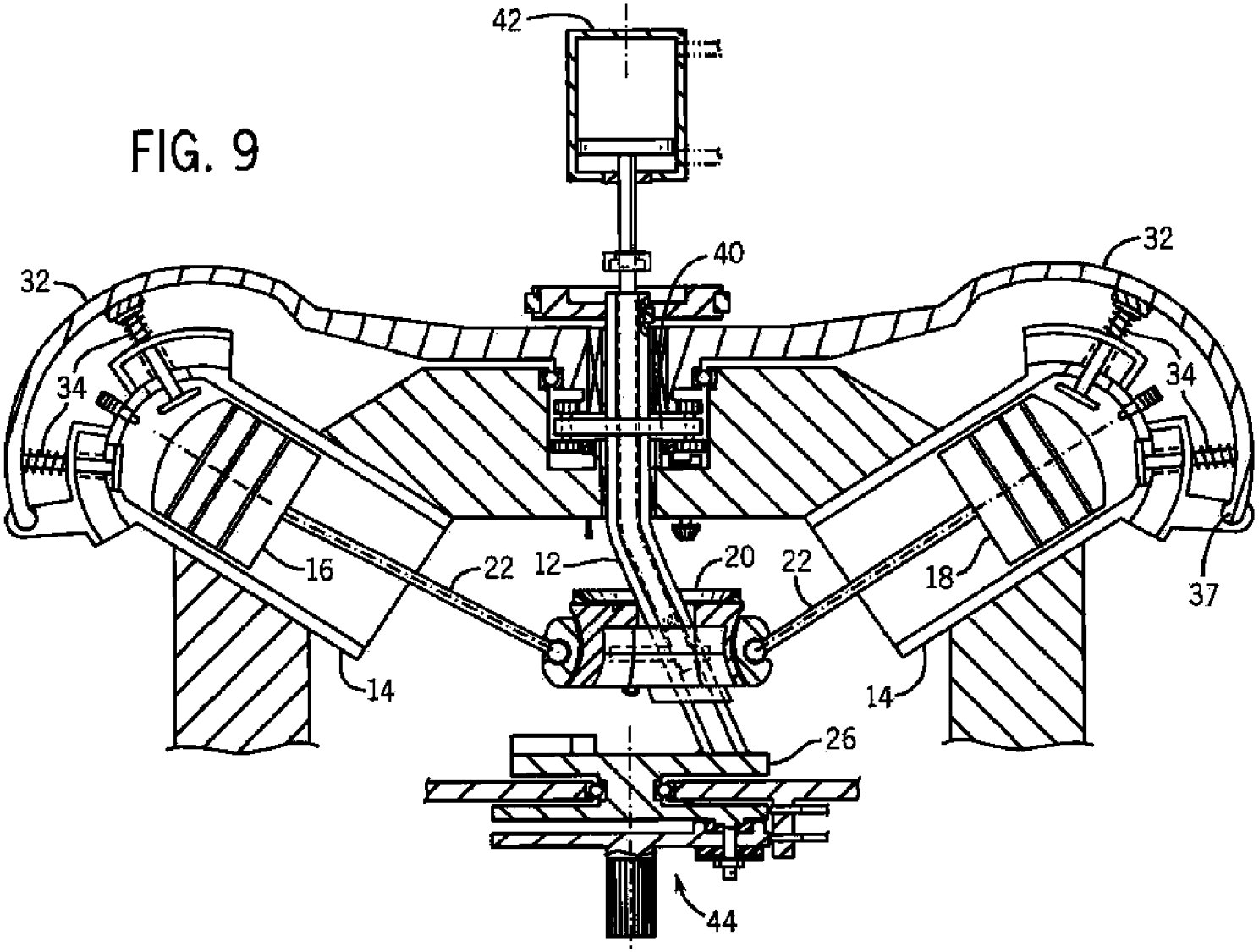
FIG. 9 is a sectional view taken along line 9-9 of FIG. 8.

FIG. 9 is a cross-sectional view of the circular radial engine taken, as shown in FIG. 8, to illustrate further detail of the major engine components, including the dome-shaped valve wheel 32 and gear drive mechanism 40. The valve wheel's dome shape adds strength and more easily reaches valves 34 on either side of the cylinder's head. The valve wheel is 360 degrees circular. The valve wheel is driven by a gear-train in the center of the engine and has variable valve timing built in. Valve timing compensation takes place when the cam mechanism rotates and changes the compression ratio. The gear-train is placed within a cavity of the engine's housing. The housing surrounds the cylinders and holds the upper main bearing. It also holds a main bearing on the lower portion of the crankshaft assembly.

Inside and underneath the valve wheel is a track for each row of valves. The tracks are fitted with another special track made from hardened steel. The tracks are properly engraved and/or embossed as needed to contact all valves lined up underneath each track. As the track slowly passes over each valve, it will either skip or activate the valve depending on the embossing and the speed of rotation. The single valve wheel with just a few tracks will replace the numerous camshafts, gear-trains, bearings, and drive mechanisms normally associated with modern V-6 or V-8 power plants. The valve wheel will advance or retard all the valves at one time.

FIG. 9 also shows further detail of rod bearing 20 traversing crankshaft 12. Hydraulic cylinder 42 moves the sliding mechanism up and down. The present embodiment has the hydraulic cylinder outside of the crankshaft and uses a swivel to isolate the rotating movement of the engine from the cylinder. Hydraulic cylinder power unit 42 provides the motive power to drive the cage up and down and thereby vary the engine displacement. The hydraulic power unit 42 is fastened to the frame for support. The swivel allows the engine to rotate without affecting the power unit 42. While the motive power is shown outside of the main crankshaft 12 for easy servicing and inspection, it can also be placed within the crankshaft mechanism if so desired, and powered by electricity, hydraulic fluid, or mechanical means.

The lower assembly 44 is a flywheel and base for the crankshaft 12. The crankshaft could be dissembled from the bottom to easily allow the cage and bearing assembly to slide onto the crankshaft. The lower assembly 44 is isolated from the power takeoff by a flexible rubber-like sleeve. The flywheel configuration is shown to illustrate how a sensor could be installed on the system. Alternately, the flywheel base could be made using other types of sensors. The present sensor system gives a direct reading on the torque the engine is producing as it powers the main load, thus working independently of the fuel being consumed. The sensor can be connected to the onboard computer and used to fine-tune the fuel distribution and all the other available adjustments in order to get necessary power at reduced levels of fuel usage.

Figure 10:
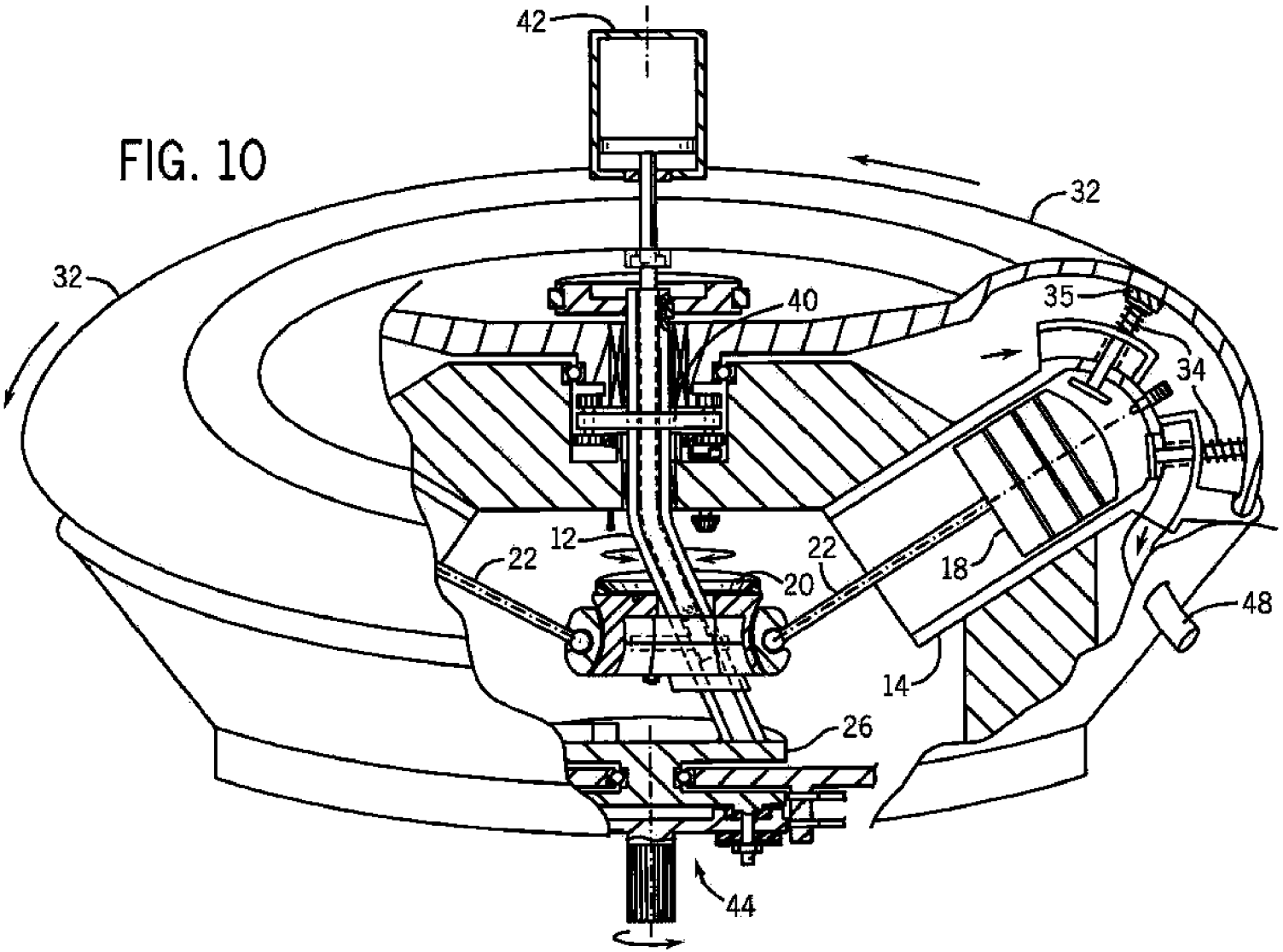
FIG. 10 is a sectional view showing further detail of the overall engine design and valve wheel.
Figure 12:
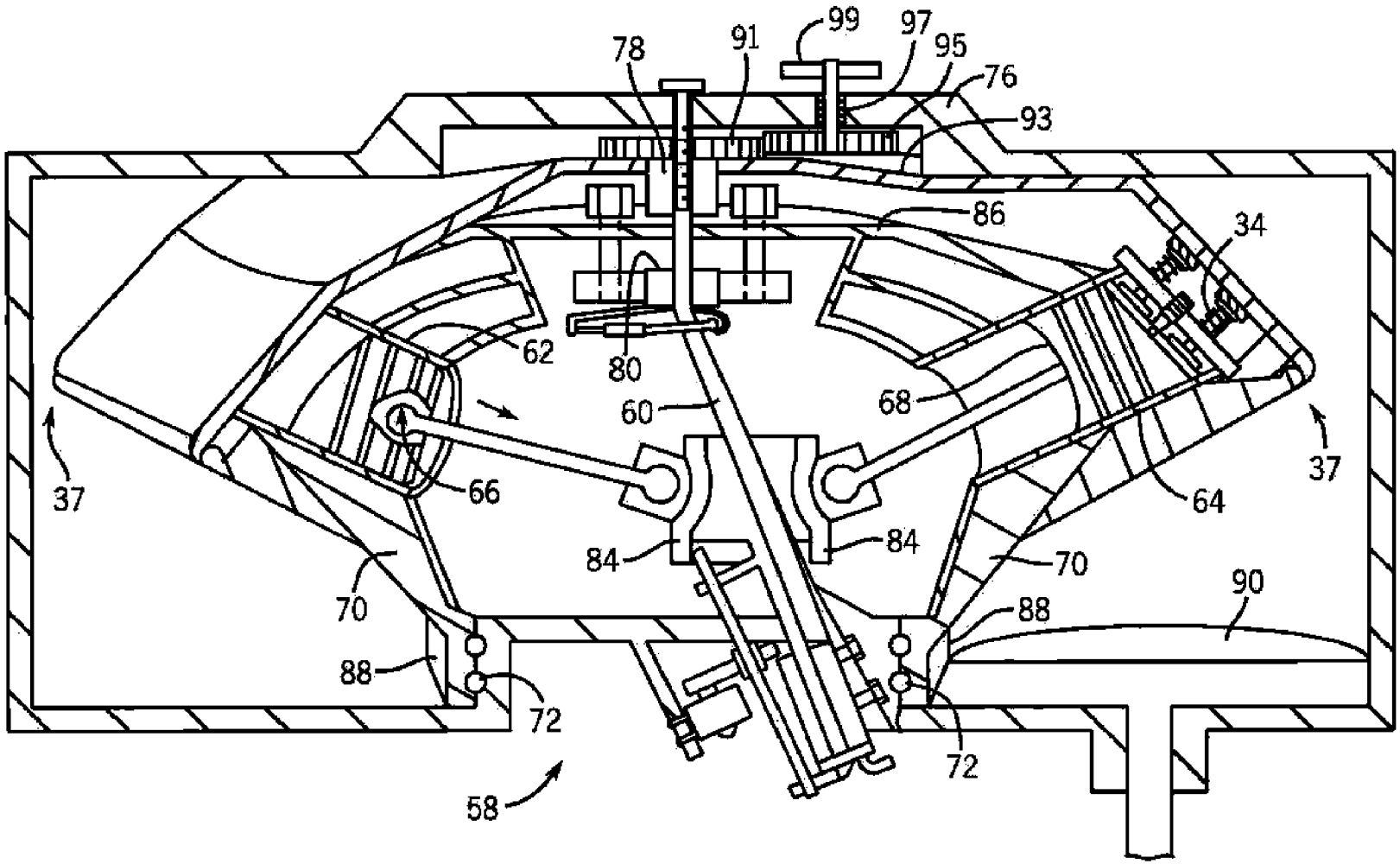
FIG. 12 is a sectional view of the X3 engine design.

FIG. 10 is a cut-away view of the valve wheel 32 showing interior portions of the radial engine as discussed in FIG. 9. The valve wheel is a wheel that is placed just above the valve activators; it is a large geared wheel that moves slower than the revolutions per minutes (RPM) of the engine. The outer portion of the wheel can be curved to fit the several rows of valve activators 35. The wheel, made of a lightweight material, has a slot within to allow hardened metal circular rings to be held permanently in place. The valve wheel uses a gear box with bearings at the top center of the engine. It also has an outer bearing 37 to maintain alignment and support, as shown in FIGS. 9 and 12. The rings are embossed and/or engraved to allow the valve activators on the top of the cylinder head to be pushed down or raised up as needed to activate then release each valve as the valve ring passes over each valve. The engraved/embossed valve rings are used in place of conventional cams used on most engines. One valve wheel and four embossed/engraved rings can easily operate all cylinders having four valves on its cylinder head, while six rings could operate six valves on each cylinder. This configuration can be used on radial engines regardless of the number of cylinders on each bank. To accommodate more cylinders, the ring is just made larger in diameter to match the diameter of the top of the cylinder heads. Additional engraved/embossed units are just added to the valve ring without using additional gears or bearings. The system replaces many gears and shafts and bearings used on conventional engines, reducing friction and parts needed to activate the valve. The valve ring may not be suitable for all engine designs; standard valve configuration or electronic valve activation may be more suitable in certain engine configurations.

In FIG. 10, the engine is placed on a slight tilt so the valve wheel is more clearly shown. The arrows indicate shape and direction of movement of the valve wheel. The valve ring is shown just above the activator 35 in the cutaway view. Air for combustion enters through slots or openings in the center of the valve wheel and makes its way to the intake ports of the intake valve system. Additional air could enter to aid in cooling of the cylinders and heads. An exhaust port 48 is shown on the right side of the engine. Each cylinder would have at least one exhaust port that may be connected to each other as the exhaust is directed away from the engine via the exhaust manifold.

Figure 11:
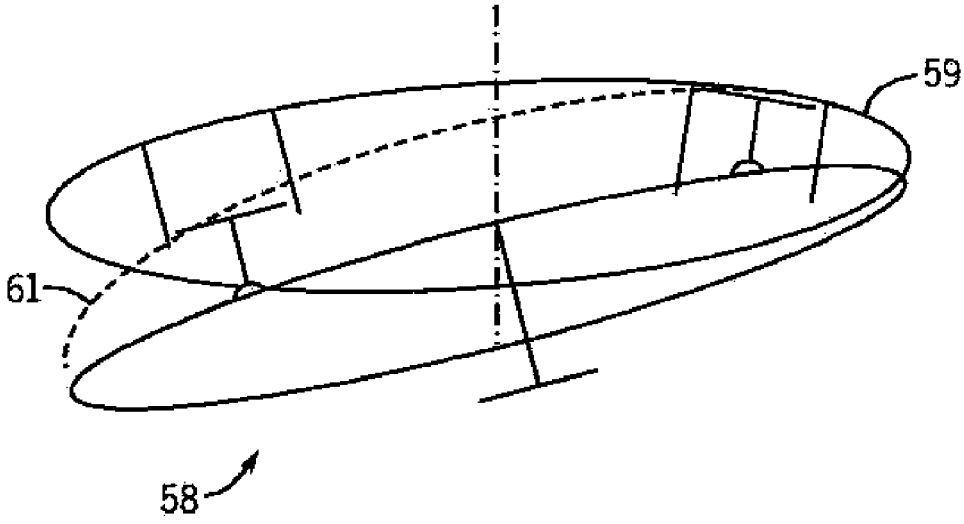
FIG. 11 is a simplified view of the rotating orbits of the X3 engine design.

FIG. 11 illustrates another embodiment of the radial engine design, referred to hereinafter as the X3 engine 58. FIG. 11 illustrates a simplified model of the orbiting engine. Oval 59 represents the fixed cylinder orbit established by the rotating framework holding the cylinders in place. Oval 61 represents the piston orbit, which pivots at the adjustable crankshaft, thereby making significant adjustments being discussed possible. Because of this principle, the present engine design has proven cylinder and piston reliability, and yet gives the same smooth performance as a rotary engine. The cycling piston movement is simulated as the two orbits work together. There is no actual up and down movement of the pistons, but it gives exactly the same effect as if there were. The engine offers smooth power at higher revolutions than conventional engines. The limiting factor for the engine is the ability to load up the air and fuel and the speed of combustion itself.

FIG. 12 illustrates further detail of the X3 engine 58. The principles previously described are the same for the X3 engine, with the exception that the cylinders and the pistons of the X3 engine 58 revolve about the crankshaft. The X3 engine 58 provides the same principles of variable displacement and compression ratio as discussed for FIG. 10. The pistons still stay in the cylinders, but they each revolve in different orbits. In conventional engine designs, the piston goes to the top of the cylinder, stops, comes back down, stops, and then goes back up. In the X3 engine 58, an orbiting principle is used to conserve energy and allow the engine to operate faster. Conventional engines have only the crankshaft and pistons in motion. In the present engine design, the cylinders also rotate to give a slightly larger movement of mass, while eliminating the heavy cast iron crankshaft and flywheel. The revolving pistons, individual cylinders, and head act as the flywheel. Modern technology and materials allow the engine to be strong, lightweight, and durable.

The main components of the X3 engine 58 include a stationary crankshaft 60, i.e., the crankshaft is fixed and does not rotate. Instead, cylinders 62 and 64 move around with pistons 66 and 68 inside the cylinders. The cylinders 62-64 are mounted to a structure or framework 70 that rotates on bearings 72 at the lower base and separately revolves around the crankshaft. The pistons 66-68 rotate about an axis of crankshaft 60. The cylinders 62-64 have their own orbit, and the pistons 66-68 are in the orbit established by the crankshaft. When the two orbits come together, the engine gains compression. When the two orbits put the piston and the cylinder further from one another, the engine undergoes decompression. The action is circular, so there is no abrupt up and down motion. Therefore, energy is not wasted as in conventional engines, where each piston must stop and reverse itself. The operation resembles a rotary engine, but can have regular round or custom oblong rounded pistons. The pistons may have oblong tops to keep the pistons properly positioned without creating excessive wear. Note that cylinder 66 and 68 are not perfectly round. They are rectangular with well-rounded corners that almost make them round. This custom design allows better and more plentiful valve placement, as well as keeping the pistons properly oriented within the cylinder.

In addition, the wider piston can more easily accommodate additional valves. Six valves per cylinder can be achieved. The sockets and balls are used on each piston to accommodate adjustments and movement on more than one plane, so there needs to be a way to keep the pistons in proper alignment so that the valves will clear.

The present X3 engine uses a variable strength valve return 37. Conventional engines use fixed strength valve returns, which are engineered to close each valve (some have 32 valves) quickly regardless of the RPM of the engine. The valve strength must be very strong, allowing the valve to snap closed at the highest RPM. At slower RPMs, the strength is wasted, putting additional drag on the valve system and robbing the engine of power. On the X3 orbiting engine system, the valve spring strength functions at low to medium speeds. The G-forces created by the centrifugal force generated by the rotating cylinders augment the strength of the valve return proportional to the strength needed to snap the valve closed at all speeds. The weight and angle of the valve and valve spring are calculated to properly augment the strength of the valve spring as the RPM and G-forces increase. In some cases, an additional weight is added to provide extra strength.

The crankshaft assembly is supported at the top by frame 76. Main bearing 78 supports the valve wheel assembly. The valve wheel moves relatively slowly in relationship to the cylinder assembly. Reference gear 80 provides a base that the other gears move around, i.e., the other gears walk around base gear 80. The base gear is held solidly in place by a first lever. Since the crankshaft is stationary, a second lever is used to hold it in place. A small hydraulic cylinder can be used between the two levers in order to change the reference point. When the lever is moved, it will either increase or decrease the position of the valves, which provides variable-valve timing. The X3 engine 58 uses variable-valve timing to adjust the valve performance to different loads and speeds, as this engine is capable of extremely high speeds. It is also used to keep valves in time, as cam 84 is rotated to vary the compression ratio. The concentric movement may make it beneficial to readjust the ignition and valve timing. Teeth 88 are disposed around the base of the rotating cylinder assembly. Teeth 88 remove power from the engine, since the crankshaft is not moving. Gear 90 distributes the engine's power to the load. Gear 91 is mounted on top of the valve wheel 93 and secured thereto in order to drive gear 95, which in turn moves through bearing 97 connected to a shaft and pulley 99, creating an auxiliary power take-off on the top of the engine.

Because crankshaft 60 is anchored, it is easy to install the mechanism that changes the displacement below the engine floor. The motive unit that changes the compression ratio can be installed in the same base. The motive unit can be made to operate at all times, even with the engine running, which makes it possible to have more precise settings for compression, as well as for displacement, while the engine is operating.

The gear mechanism 86 operates the valve wheel. The gear mechanism that runs the valve wheel is powered from the structure that houses the cylinders. The cylinder plate of gear mechanism 86 drags the cluster of gears around from the center of the shaft of the upper and lower gear. Those gears are engaged just above the semi-fixed reference gear, which causes the lower gear to rotate which, in turn, allows the top gear to rotate. The top gear pulls the valve ring around, but also can either speed it up or slow it down depending on gear ratios, position of the take-off gear, and position of the semi-fixed adjusting reference gear. The valve wheel has support bearings on its outer edge, which are mounted on the rotating cylinder framework.

The reference gear 80 attached to the anchored crankshaft regulates its operation. Changing the position of the reference gear (forward or reverse) will advance or retard the valve mechanism as needed; see the small hydraulic cylinder on the mechanism just below the gear train. The hydraulic cylinder is attached to the reference gear and provides the variable valve timing and is continuously monitored and adjusted by the onboard computer.

Figure 13:
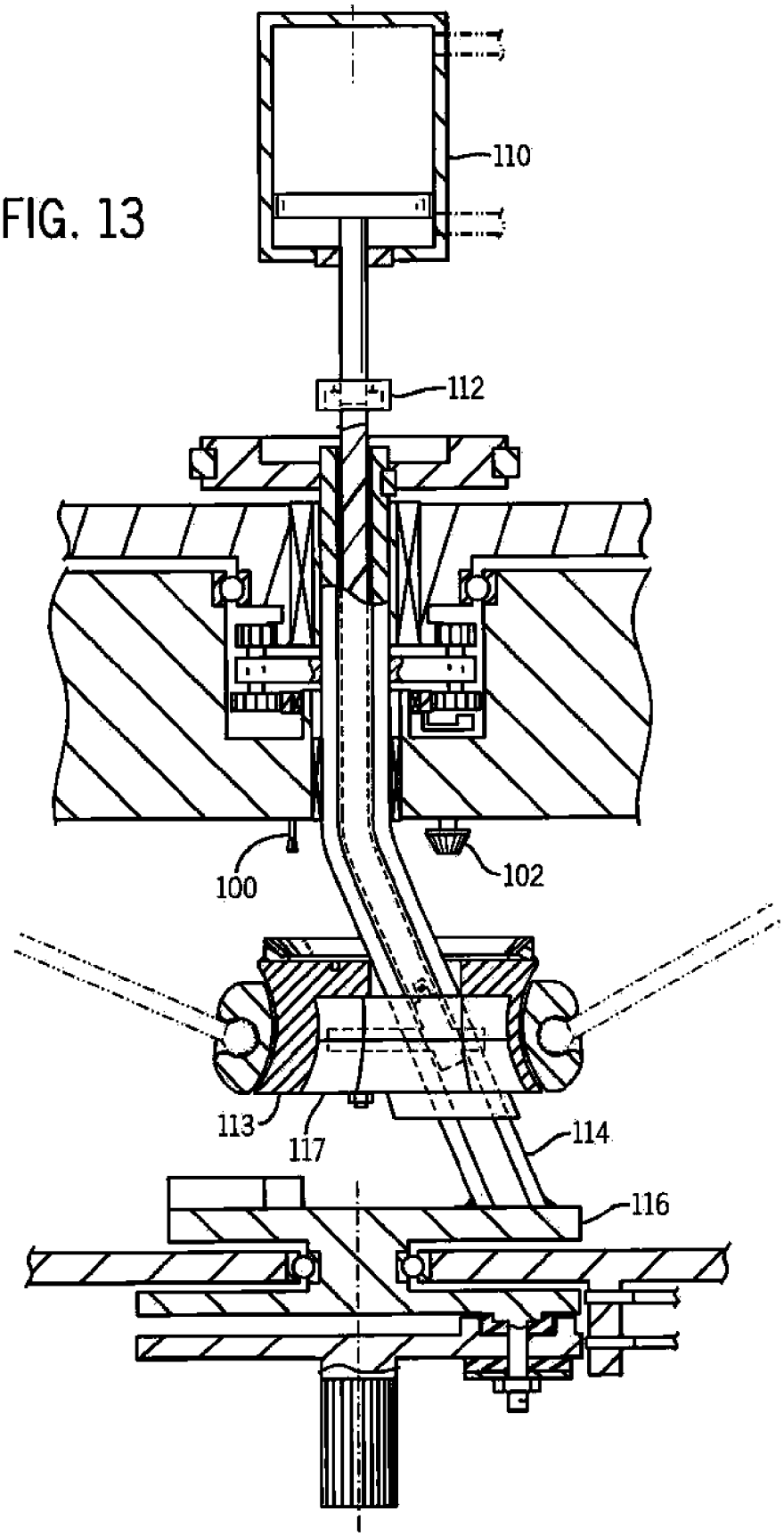
FIG. 13 illustrates further detail of the crankshaft assembly and gear-train.

FIG. 13 illustrates further detail of the crankshaft assembly and gear-train from the original engine design of FIG. 9. Rod 100 unlocks the gears that drive the cam. Once the gears are unlocked, gear 102 moves the cam gears to a new setting, which allows the engine to utilize a different compression ratio. A different fuel can be used with the new compression ratio.

The hydraulic plunger device 110 is used to pull the center rod up and to press it down. Swivel 112 is located under the motive cylinder. Swivel 112 isolates the revolving portion of the crankshaft from the non-rotation of the motive cylinder. The center rod moves the cage assembly 117 as needed. The rod may be round or square or any other configuration. The rod could be solid at the top and then flexible near the bottom where it must be made to negotiate the curve in the crankshaft assembly. Alternatively, a special custom drive shaft chain could be used to allow it to be flexible enough to go through the curve in the crankshaft, yet push and pull cage 117 with precision. A slot at the bottom of the flexible rod is provided to insert the pin and hold cage 117 in place. Cam 113 rotates in order to change the compression ratio. The crankshaft main shaft 114 is fastened to a plate 116.

Plate 116 is part of a flywheel with the main bearing in the center. To assemble this unit, the main bearing assembly 114 can be detached from the rest of the frame, which will allow the crankshaft to drop down, so it can be assembled by pushing it up from the bottom into the top portion, and then re-securing it to the lower plate. The frame panel, where the lower main bearing is held in two pieces, comes apart to install or service the main lower bearing. Cage 117 can be assembled and then put on the shaft before the entire crankshaft is assembled.

The lower middle portion of the flywheel is connected to the main output using a type of vibration-dampening system. One of several pins surrounded with rubber-like units connects the two plates together to transfer the torque and allow the speed of the main output plate to fall slightly behind the engine at times of heavy load.

The laser sensors measure the minute differences in the lag time of the load and report it to the on-board computer to measure the actual power being produced and delivered to the load. The sensor or another power measuring device sends the readings along with other engine sensor readings to the onboard computer to continuously monitor the engine's efficiency and fine-tune all the variable adjustments of the system, including fuel temperature, fuel pressure and distribution, variable compression, variable compression ratio, variable valve timing, variable ignition timing, and/or injector timing. It also selects the best type of fuel to be used overall for a particular assignment. The computer may also select the best operating temperature to maximize the selected fuel's combustion and reduce hydrocarbons and other combustion pollutants.

Figure 14:
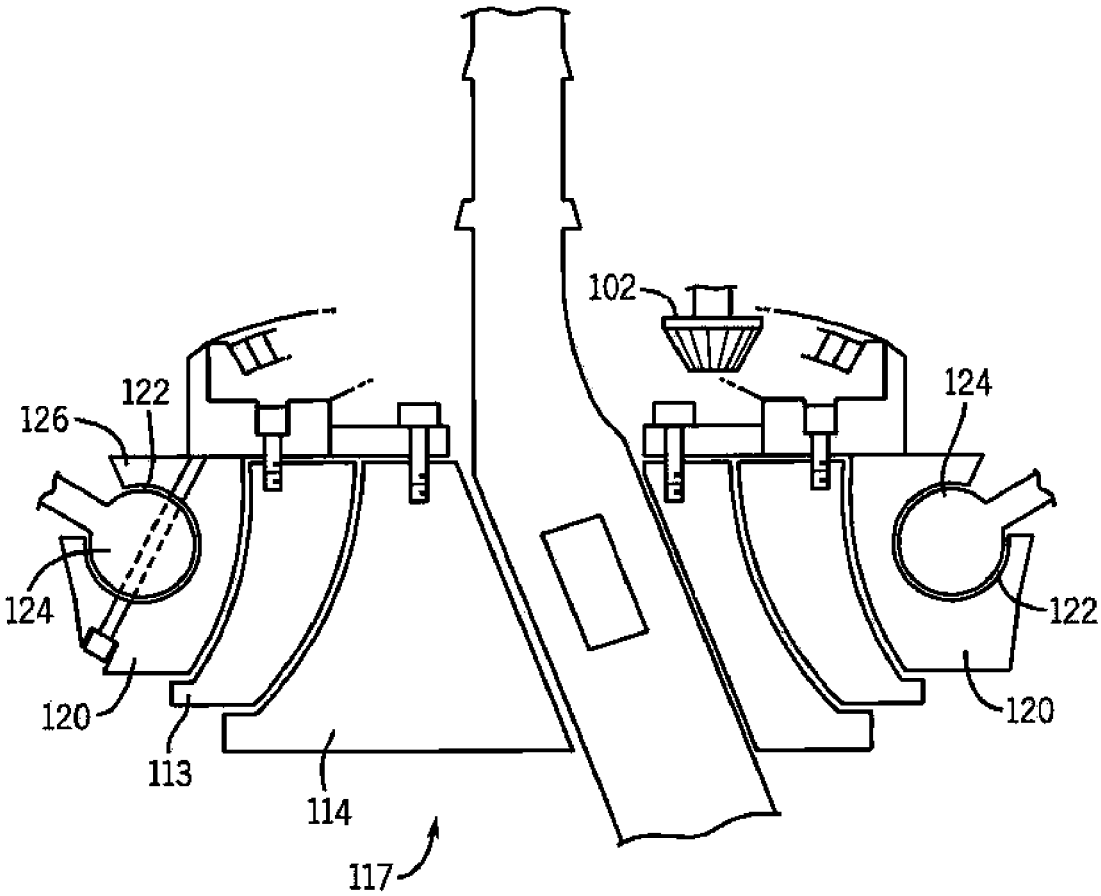
FIG. 14 illustrates further detail of assembly of the cage.

FIG. 14 illustrates further detail as to how cage 117 can be assembled. Cage 117 is heavy duty as it receives substantially all the torque that the pistons deliver to the engine. The inside of the cage is pentagonal or octagonal in shape, which allows it to stay in place as it is moved along the shaft. The cage 114 must hold the bearings so that they are always aligned in a horizontal and vertical plane to prevent vibration in the mechanism. The outermost bearing assembly 120 is directly connected to the cam assembly 113 and holds the sockets 122 for the piston rods. Both ends of the rods are supplied with a ball 124. Each ball 124 fits into a socket on this outer bearing while the other end fits into the socket in the piston. After the balls are installed, then the top half 126 of the outer bearing is put on and secured by a number of bolts or other types of connectors. However, note that one rod has a ball on one end but the other end has a bearing that resembles a hinge; it does not allow lateral movement of the master rod that it controls. The master rod pulls the bearing assembly around, always keeping it aligned with the master cylinder. Because this cylinder is always perfectly aligned, it keeps the other pistons substantially aligned with their own cylinders. Ball and socket connections are used for all of the articulating rod bearings to allow movement in two directions. One direction is the normal piston movement; the other direction is used to change adjustments. FIG. 14 shows in greater detail how the proper angle will allow for easy construction and maintenance.

Figure 15:
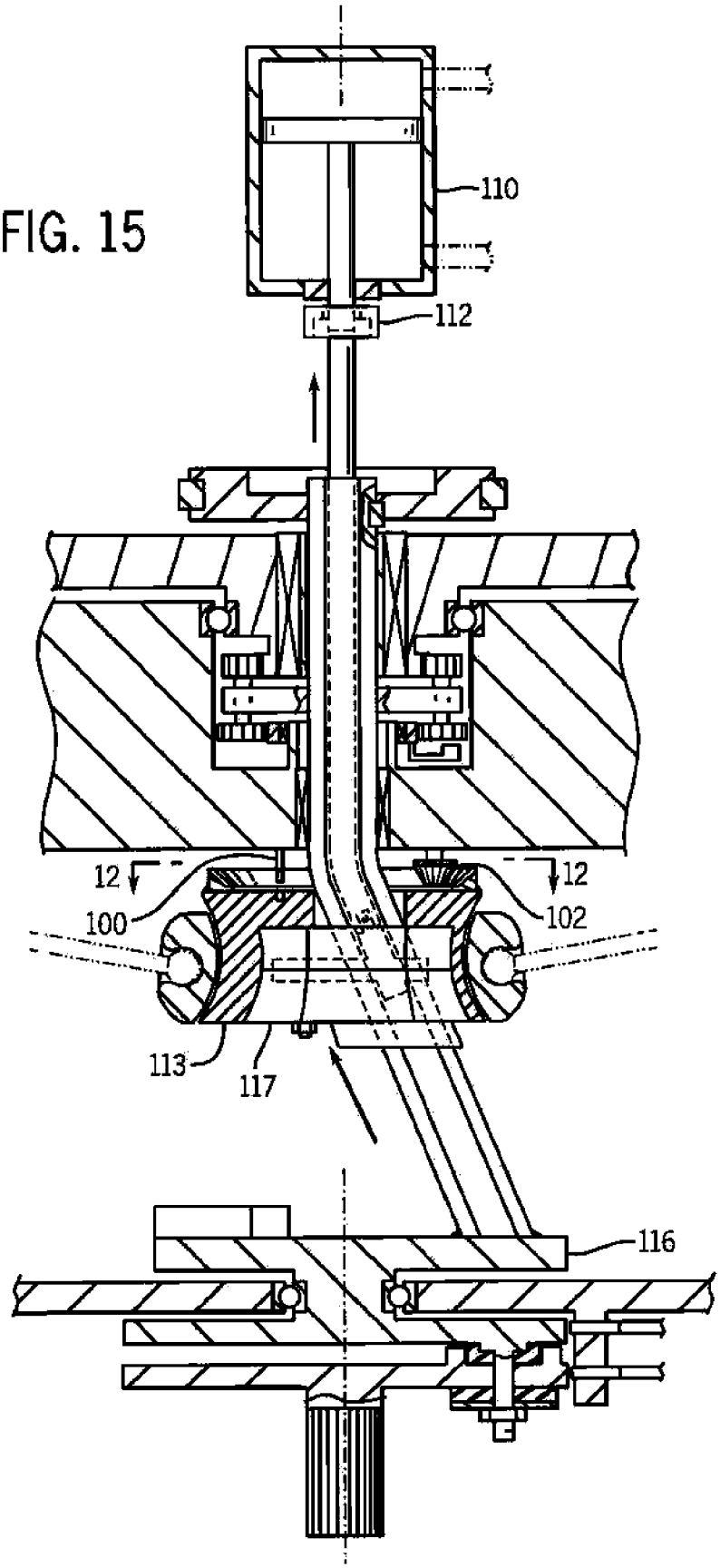
FIG. 15 illustrates the cage in the top-most position.

FIG. 15 illustrates cage 117 pulled all the way to the top. The compression ratio adjustment is done at this time while the engine is turned off. Some models will allow the compression ratio to change without first turning off the motor. The model denoted here as the X3 has provisions for the compression ratio to change while the engine is in operation. In this version, cage 117 must move up precisely so that gear 102 can be energized independent of where the engine stops. The small lever on the left pushes down on a control ring positioned on cage 117 in such a manner that a locking device inside the cage releases the lock while the cam is being repositioned. When cage 117 moves away, it locks back to the new setting.

FIG. 16 illustrates a top view of the crankshaft mechanism. Rod sockets 140 are shown along with master rod bearing 142. The master rod has been previously mentioned; it keeps all the rod sockets lined up with their respective cylinders. Gear 144 moves the cam. Cage 146 carries the cam and other items up and down. Cage 146 rides on the crankshaft, but it is machined so that it cannot rotate except as one with the crankshaft. The front of the cage and the front of the crankshaft are always in the same position shown by reference point 150.

FIG. 17 illustrates cage 117 at top range of motion and ready to be repositioned. The unlocking pin 100 has been activated, and gear 102 is ready to move the cam to a new position. The flexible rod that pulls and pushes the cage is shown. The rod is shown in a round hole, but it can also be in a square or rectangular hole, depending on its design. The pin device 160 goes through the flexible rod. It travels in a slot to engage the cage and keep it in the proper position. Cage 162 is similar to an elevator cage and travels up and down on the machined crankshaft. The crankshaft holds the cage very firmly, keeping in alignment as it moves. The back bearings for cam 166 fit directly on the outer bearings of the cage. The outer cam bearings 164 retain the main bearings that hold each of the rod sockets 170. Sockets 170 are placed onto the main bearings to match the rods which have a ball on each end. There is one master rod, having a bearing that does not allow lateral movement (see master rod bearing 142 in FIG. 16), which keeps all the rods properly aligned with their respective cylinders. The illustration FIG. 17 shows the cage moving down to the middle of the crankshaft. As it moves downward, the engine's displacement will increase. The angle of the movement pulls the piston away from the engine's head, keeping the compression ratio the same. These two work together to keep the compression ratio substantially constant as these changes are taking place. Reference 150 is the front of the crankshaft, and reference 152 is the back of the crankshaft. The front side is significant because it moves the top of the piston as close as possible to the cylinder's head. This is the maximum throw for the piston. The top of the piston at maximum throw is what sets the compression ratio. If the cam were non-existent, the maximum throw would always be the same. Reference point 164 shows the thinnest portion of the cam and its position at the side of the crankshaft, as shown in FIG. 16. The compression ratio in this instance would be medium compression because the piston would not be driven all the way to the top. If the cam were moved 90 degrees to the right, then the compression ratio would be high, as the extra width of the cam would be added to the previous maximum throw of the piston. It can also be moved in smaller increments to make other in-between adjustments. As the cam moves it gets wider on one side and thinner on the other side, these side and back changes are of little significance since the compression ratio is determined only at maximum throw (front of crankshaft). There could be a minor change in valve operation, but the variable valve and ignition timing will automatically be corrected by the onboard computer. The up and down movement of the cage changes the displacement; only the cam settings affect the compression ratio.

Figure 18:
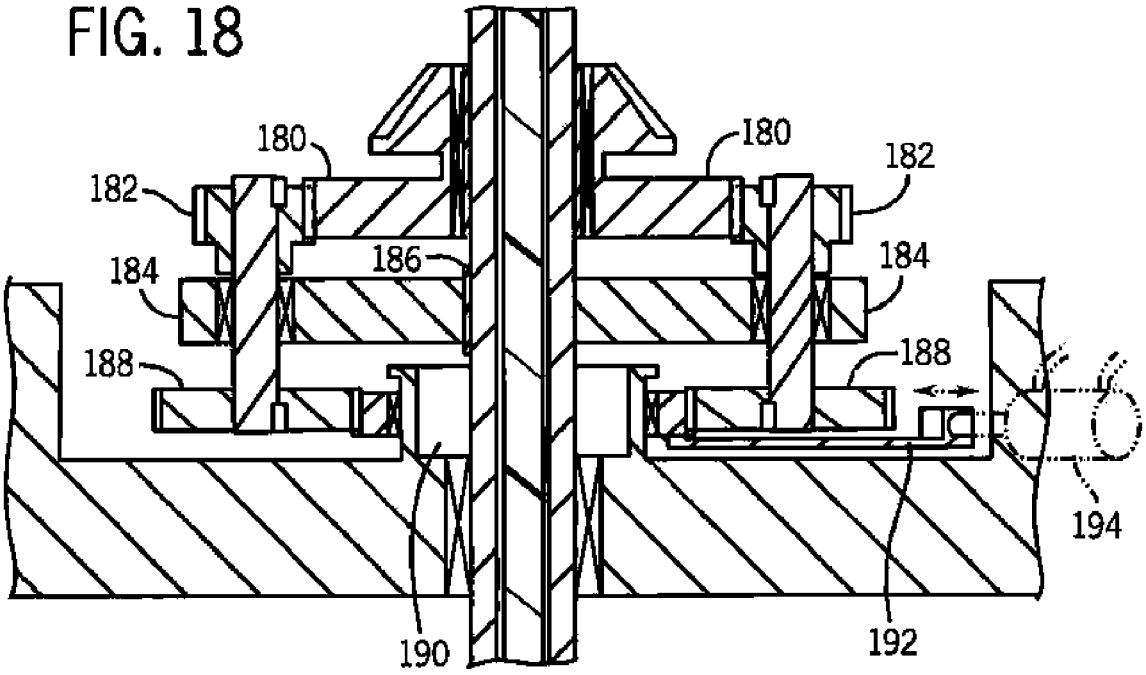
FIG. 18 illustrates a gear, which can go to a separate shaft to drive the valve train.

FIG. 18 is an exploded view of the gear assembly utilized on most of our engines. It can drive a gear which can go to a separate shaft to drive the valve train on some engines, e.g., the compact design 4-cylinder or compact 8-cylinder. That same gear can also be the power hub for the valve wheel on the engine shown in FIG. 9, or it can be the hub for the valve wheel on the X3 engine. Gear ratios can be established for either power plant. Moving down from the top, there is another large gear 180. Teeth mesh on it from smaller gears. The shaft of the smaller gears 182 have bearings in their centers, which go through a drive plate 184. The drive plate is fastened to the main driveshaft. A key 186 allows the driveshaft to drive the plate. The smaller top gears do not just turn to move the upper gear. Since the top gears are themselves continuously moving because their center is connected to the moving plate, these gears actually drag the upper gears around while turning slowly only to adjust to the proper gear ratio. The lower gears run against a gear that is semi-fixed. The semi-fixed gear is able to rotate a portion of a turn right or a portion of a turn left. As these adjustments are made, it serves to advance or retard the motion of the output gear, thereby advancing or retarding the variable valve mechanism.

In FIG. 18, at time of manufacture, the overall ratio of the valve wheel or gear train can be adjusted by altering the size of the upper gear 182 and lower gear 188 to reach the preferred ratio for the size and type of engine being produced.

In order to advance or retard the reference gear 190, it must be connected to the frame with a moveable lever 192. To the lower right side of it is a small power cylinder 194 used to make those small movements. If the lever is traced back to the center where the semi-fixed gear is placed, the gear can rotate forward or backward as needed, which is how the variable valve timing is accomplished.

Figure 19:
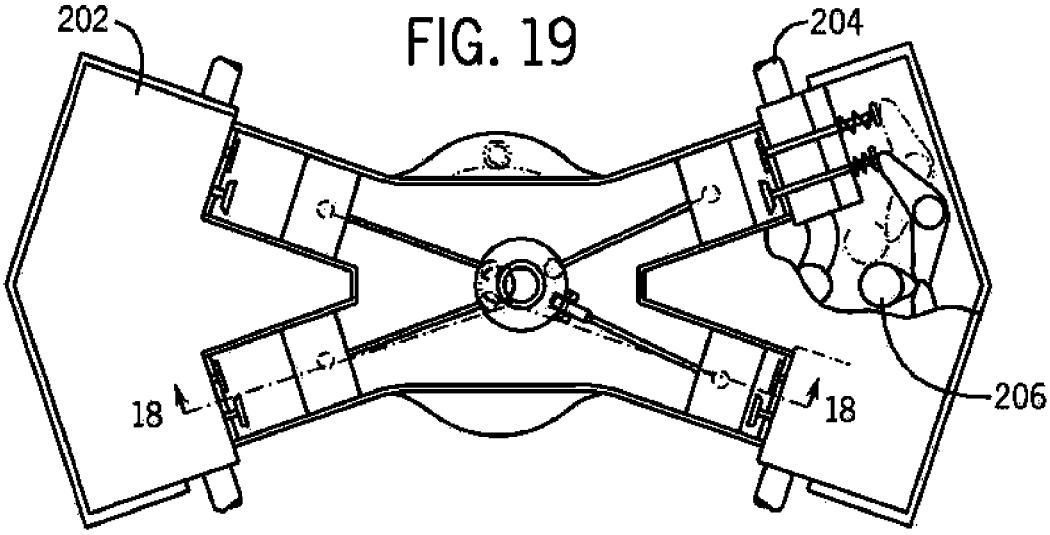
FIG. 19 is a compact engine design that will fit most of the available automobile engine compartments.
Figure 20:
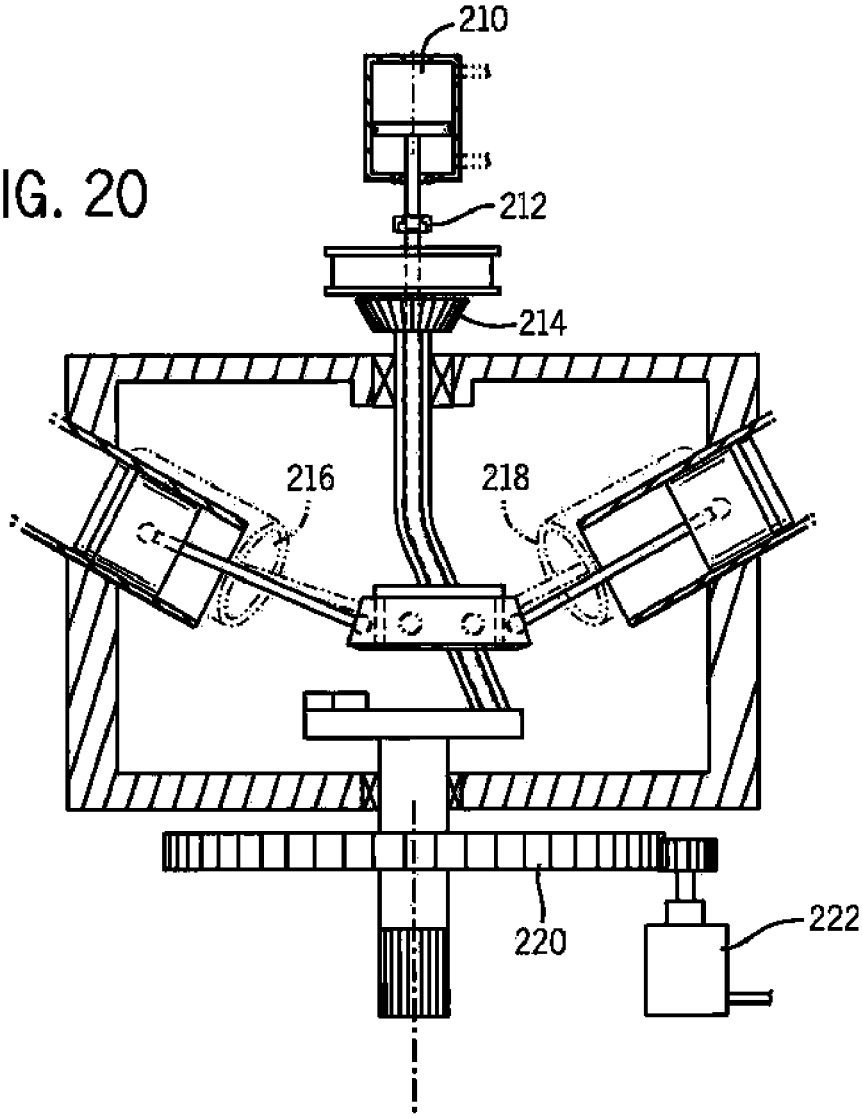
FIG. 20 is a top view of the compact engine design of FIG. 19.
Figure 21:
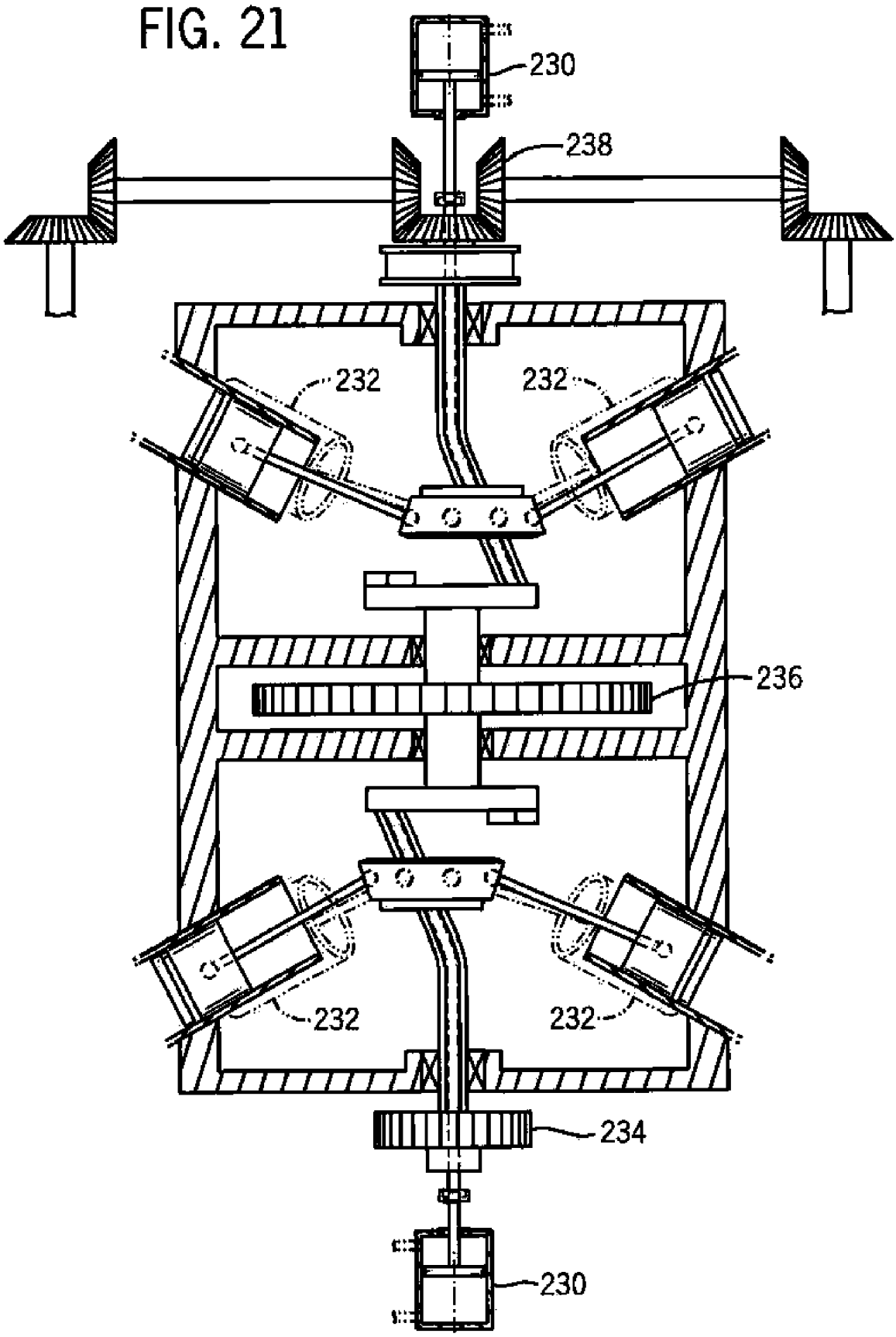
FIG. 21 shows two compact engines connected back to back.

FIGS. 19, 20, 21 illustrate that the present engine design can be produced using a variety of configurations. The engineering principles explained elsewhere apply to these figures. Since the valve wheel needs to be 360 degrees circular in nature, the standard engines will tend to be circular and slightly larger then some current conventional engines. These optional slimmer compact models operate like the others, except they use conventional or alternative valve system designs. Radial engines normally have cylinder layouts showing 3, 5, 7, 9 cylinders on each bank. The valve system is able to provide even smooth power, and it lends itself well to the valve wheel design. Firing order is altered to produce smoother power; however, it may not be quite as smooth as the circular radial engine since the cylinders are not spaced at equal distance to each other. A variety of conventional cylinder heads and designs can be utilized. A number of motorcycles have cylinder and valve designs that work well in this compact unit. Since each cylinder head has a different alignment, electronic valves would also be a good choice.

FIG. 19 is a front view of FIG. 20. On the left is the valve cover 202. On the right is one of the exhaust or intake ports 204. Common cam 206 jointly operates the valve system for those two cylinders. In FIG. 20, motive unit 210 changes the displacement of the crankshaft. Swivel 212 isolates the motive power from the rotational forces of the revolving engine. Gear 214 can operate one or more geared valve systems. Above it is an auxiliary power takeoff and a gear to drive valves. Two of the cylinders—cylinders 216 and 218—are below the other two cylinders. All have the same angles as FIG. 9 illustrations and operate in the same manner. The flywheel and teeth 220 for starter 222 are shown.

The compact engine design of FIG. 19 fits most of the available automobile engine compartments. The compact design uses the same principle as described in FIG. 9, given the removal of some of the cylinders. Conventional valves are used since the engine design is no longer circular. Electronic valve technology is improving and it could help simplify the compact designs of this engine.

FIG. 21 is two compact 4-cylinder engines connected back to back, much like a V-8 is two 4-cylinder engines connected on the same crankshaft. Because a control device 230 is needed on each set of cylinders 232, engine power is transferred through the gears 234. If the crankshaft mechanism is built in, then power could be removed conventionally. The flywheel 236 could be on either end or in the middle; it also serves to operate the starter system. The cylinders have to be set up to give the smoothest possible operation. Gears 238 are shown to drive the valve system. This can be removed if electronic valves are installed.

FIG. 22 illustrates an on-board computer or electronic device 250 for monitoring and controlling functions of the engine. Common electronic devices are oxygen sensors, heat sensors, airflow monitors, tachometers, and speedometers. Sensors feed the data into the computer and the fuel is more precisely dispensed and, in some cases, the ignition is advanced or retarded.

The present engine features a variable displacement system as well as variable valve timing. The engine will adjust its size internally to match the immediate power needs of the driving situation. When more power is needed, the engine gets larger inside; when less power is needed, it gets smaller inside. In this way, the engine operates continuously at or near maximum efficiency. In addition to the above, some engines are equipped with the variable compression ratio feature, which allows the driver to select from a number of available fuels. The engine will make an adjustment and switch the compression ratio to the correct one to match the fuel selected; it will also switch to a second fuel cell. The onboard computer will be able to store the necessary information that will allow these changes to take place. The onboard computer will send data to show exactly how much power is being generated at any given time.

The onboard computer will also give a readout of the torque being created as the engine operates. The computer does this by laser-monitoring the exact speed and position of each dot on the wheel directly connected to the output of the engine. There is a second identical wheel connected to the engine's load. When the engine is not running, the dots on each wheel will match perfectly. These two wheels are connected with rubber-like power-transfer modules. As power is being used, the rubber buffers compress slightly, causing the second disk to lag behind the first in proportion to the power being used. The computer measures this distance to calculate the amount of torque being created.

One of the main functions of the computer is to watch the driver's accelerator pedal. The more the pedal is pushed, the faster the vehicle goes. Pushing the pedal would first open the throttle. As the engine reaches or nears maximum power for its displacement, the computer would increase displacement if the pedal were still being depressed. However, when backing off the pedal, the throttle would first be reduced, and the power level would come down; yet, the displacement would not be reduced for a few additional seconds in case the throttle were again quickly depressed. Additionally, the driver can press a button on the computer to tell the computer to operate the engine normally, in super-economy mode, or in extra-power mode.

In addition to measuring the overall torque, the onboard computer can do a number of other things. The computer can measure very precisely the speed of the engine. In addition to reporting the overall torque used, the computer will notice a tiny pulse on the power wheel each time a cylinder fires. Since the computer also controls and monitors the ignition, it can tie each pulse to a separate cylinder. Thus, the computer can tell how strong each individual cylinder is firing. The computer can change some of the settings and again analyze the power from each cylinder. Such information can be used to alert the driver that certain items need attention like a partially-clogged fuel injector or a faulty sparkplug. After consulting with the driver, the computer will attempt to correct some of the engine's problems.

The most important task for the onboard computer is to select the proper position for the variable compression mechanism as well as the variable displacement mechanism. The torque produced from different types of fuel will be kept on file along with other data. The information can make the driver aware of how each type of fuel has performed. For instance, a driver might want to evaluate using higher priced premium fuel against using lower priced, lower octane fuel when the engine is set to get the most out of each type of fuel. The driver can have the computer compare the performance of these two fuels. The computer would then adjust for the settings for that particular fuel, switch to the proper fuel cell, operate briefly, and record the results. The computer would go to the second fuel and repeat the sequence. The torque, performance, emissions, and fuel used would be factors used by the computer in comparing the two fuels. Since the present engine can adjust the compression ratio specifically to match the fuel being used, the driver might be surprised that the better bargain might be the premium fuel. Similarly the driver might want to compare gasoline with ethanol, diesel, bio-diesel, fuel oil, or even corn oil—all of which can be used in the present engine design.

The computer can analyze the performance of separate fuels, and use those results to help adjust the mechanisms to precise settings to get the best possible fuel economy and power. The engine is adjusted in such a manner to get the maximum efficiency from a fuel; it will burn very cleanly and operate almost pollution-free.

For faster results, the manufacturer will supply a list of popular fuels and their operating codes. A driver can select any of these fuels from the list and get faster results. The onboard computer will keep a list of all fuels actually used in the vehicle along with their operational settings and levels of performance.

In summary, an automobile is expected to run at low, medium, and high power settings. Because the present engine design can adjust to all speeds and load conditions, it will give more power and do it more economically than most, if not all, other engines. The engine can be used in marine applications to give more power and higher RPM than most engines already in use are prepared to offer. The rotary version of the present engine design can deliver more power and higher RPM than any conventional engine.

In aviation applications, the conventional aircraft engine loses power as it rises above the clouds to smoother air. From 5,000 to 10,000 feet, engine power drops off considerably, which is due to the fact that the air is thinner at those altitudes and the pistons just cannot bring in enough air. The present engine can be set to take extra deep strokes so the cylinders can become fully charged. The engine is also lighter-weight and has fewer moving parts than the conventional aircraft engine.

In power plant applications, small to medium-sized electrical power plants are expected to operate at a standard speed whether power is needed or not. Most plants run at 3600 revolutions per minute. Conventional engines use considerable fuel just running at minimum speed and power settings. The present engine reduces its displacement while keeping the 3500 RPM required speed. It will operate in a very fuel-efficient manner, yet be ready to give maximum power whenever needed.

Accordingly, by moving the journal in various positions, the length of the stroke (displacement) and the distance to the head of the cylinder can be changed, which changes the compression ratio. These features allow the engine to make adjustments while underway to a larger or smaller displacement, and at the same time to automatically adjust to the proper compression ratio, allowing the fuel to burn at maximum efficiency. The compression ratio adjustment allows the user to switch from one fuel type to another at any time. These principles apply whether the engine is designed in the conventional manner, where the cylinders are stationary and the crankshaft moves, or whether the cylinders revolve and the crankshaft is stationary.

While one or more embodiments of the present invention have been illustrated in detail, the skilled artisan will appreciate that modifications and adaptations to those embodiments may be made without departing from the scope of the present invention as set forth in the following claims.

What is claimed is:

1. An engine, comprising:

a crankshaft having a main section extending along a main axis and an offset section radially offset from the main axis;

a throw-piece mounted to the crankshaft and movable along the offset section; and at least one piston and cylinder arrangement, the piston having one end coupled to the throw-piece and extending generally radially from the crankshaft to a head disposed within the cylinder, the piston being movable a stroke distance with respect to the cylinder so as to displace a volume in the cylinder when moved through the stroke distance;

wherein movement of the throw-piece along the offset section of the crankshaft causes a changed piston-stroke distance and a changed cylinder-volume displacement by movement of the piston through the changed stroke distance.

2. The engine of claim 1, wherein the offset section of the crankshaft extends from the main section along an offset axis that is oblique to the main axis.

3. The engine of claim 1, wherein the crankshaft rotates about the main axis.

4. The engine of claim 1, wherein the crankshaft is fixed and the piston cylinder arrangement revolves about the main axis.

5. The engine of claim 4, wherein the cylinder revolves in a first orbit and the piston revolves in a second orbit that is oblique to the first orbit so as to effect relative reciprocation of the piston in the cylinder.

6. The engine of claim 1, wherein the cylinder extends along an axis that is at an oblique angle relative to the main axis.

7. The engine of claim 1, wherein there are multiple piston and cylinder arrangements angularly spaced about the main axis, and wherein each piston is coupled to the throw-piece.

8. The engine of claim 1, wherein the throw-piece is positioned along the offset section of the crankshaft to maintain an essentially constant compression ratio in the cylinder.

9. The engine of claim 1, wherein the throw-piece includes a cam defining an eccentric cam surface.

10. The engine of claim 9, wherein the cam is releasably fixed to the crankshaft so that in a locked state the cam is rotationally fixed with respect to the crankshaft and in an unlocked state the cam is rotatable with respect to the crankshaft.

11. The engine of claim 10, wherein the cam includes a drive section for engagement with an actuator to rotate the cam with respect to the crankshaft when in the unlocked state.

12. The engine of claim 9, further including an electronic control for controlling one or more actuators to adjust at least one of the axial position and the rotational position of the cam along the crankshaft to selectively control a compression ratio in the cylinder according to a type of fuel consumed by the engine.

13. The engine of claim 1, further including a flexible drive-member movable within a passage of the crankshaft and coupled to the throw-piece to move the throw-piece along the offset section of the crankshaft.

14. A multi-fuel engine, comprising:

a crankshaft having a main section extending along a main axis, wherein the crankshaft includes an offset section radially offset from the main axis and wherein the cam is adjustably mounted to the offset section;

a cam having a cam surface that is eccentric with respect to the crankshaft, at least one of an angular position and an axial position of the cam being adjustable relative to the crankshaft, wherein the cam is movable along the offset section to change the piston stroke and thereby change cylinder-volume displacement effected as the piston moves through the changed piston stroke; and at least one piston and cylinder arrangement, the piston having one end coupled to the cam and extending generally radially from the crankshaft to a head disposed within the cylinder, the piston being movable through a stroke with respect to the cylinder;

wherein the angular position of the cam with respect to the crankshaft can be selected to tune a compression ratio of the engine to a preferred compression ratio of a fuel being supplied to the engine.

* * * * *